US007721586B2

(12) United States Patent
Pabich et al.

(10) Patent No.: US 7,721,586 B2
(45) Date of Patent: May 25, 2010

(54) PRESS BRAKE TOOL SEATING TECHNOLOGY

(75) Inventors: Terry G. Pabich, Roberts, WI (US); Bryan L. Rogers, Forest Lake, MN (US); Jon M. Shimota, Stillwater, MN (US); John H. Morehead, White Bear Lake, MN (US); Ronald G. Rosene, Coon Rapids, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 1099 days.

(21) Appl. No.: 11/230,742

(22) Filed: Sep. 20, 2005

(65) Prior Publication Data

US 2006/0174679 A1 Aug. 10, 2006

Related U.S. Application Data

(63) Continuation-in-part of application No. 11/053,134, filed on Feb. 8, 2005, now Pat. No. 7,308,817.

(51) Int. Cl.
*B21D 37/04* (2006.01)
*B21D 37/14* (2006.01)

(52) U.S. Cl. ..... 72/481.1; 72/481.2; 72/481.6; 72/389.4; 72/482.92

(58) Field of Classification Search ..... 72/389.3, 72/389.4, 389.6, 462, 481.1, 481.2, 481.3, 72/481.6, 481.9, 482.2, 482.3, 482.6, 482.91
See application file for complete search history.

(56) References Cited

U.S. PATENT DOCUMENTS

| | | | | |
|---|---|---|---|---|
| 2,755,758 A | | 7/1956 | Johansen | |
| 3,779,122 A | | 12/1973 | Sawvell | |
| 4,315,425 A | | 2/1982 | Zbornik et al. | |
| 4,506,538 A | | 3/1985 | Jones, Jr. | |
| 4,534,203 A | | 8/1985 | Cros | |
| 4,612,796 A | | 9/1986 | Smyth, Jr. | |
| 4,721,293 A | | 1/1988 | Schron et al. | |
| 4,787,237 A | * | 11/1988 | Houston et al. | 72/462 |
| 4,895,014 A | * | 1/1990 | Houston | 72/481.2 |
| 4,993,255 A | | 2/1991 | Treillet | |
| 5,009,098 A | | 4/1991 | van Merksteijn | |

(Continued)

FOREIGN PATENT DOCUMENTS

| | | |
|---|---|---|
| AT | 1383200 | 11/2003 |

(Continued)

OTHER PUBLICATIONS

Wila Press Brake Productivity Guide, Jun. 2005, 217 pages.

(Continued)

*Primary Examiner*—David B Jones
(74) *Attorney, Agent, or Firm*—Fredrickson & Byron, P.A.

(57) ABSTRACT

Press brake tool holders suitable for releasing and securing press brake tools. Provided in certain embodiments are a press brake tool holder and a press brake tool, in combination. Methods of using press brake tool holders are also provided. In some embodiments, the tool holder has a mechanism for tool seating, such as a mechanism adapted for moving a tool generally parallel to a pressing axis of the tool holder.

62 Claims, 19 Drawing Sheets

U.S. PATENT DOCUMENTS

| | | | | |
|---|---|---|---|---|
| 5,022,256 | A | 6/1991 | van der Meulen | |
| 5,042,352 | A | 8/1991 | Lux | |
| 5,065,610 | A | 11/1991 | Yonezawa | |
| 5,245,854 | A | 9/1993 | Bruggink et al. | |
| 5,460,027 | A | 10/1995 | Takahashi | |
| 5,511,407 | A | 4/1996 | Kawano | |
| 5,513,514 | A | 5/1996 | Kawano | |
| 5,562,892 | A | 10/1996 | Kirk et al. | |
| 5,572,902 | A | 11/1996 | Kawano | |
| 5,642,642 | A | 7/1997 | Kawano | |
| 5,685,149 | A | 11/1997 | Schneider et al. | |
| 5,720,169 | A | 2/1998 | Schneider | |
| 5,782,308 | A | 7/1998 | Latten et al. | |
| 5,794,486 | A | 8/1998 | Sugimoto et al. | |
| 5,822,989 | A | 10/1998 | Sturdevant et al. | |
| 6,000,273 | A | 12/1999 | Stover | |
| 6,003,360 | A | 12/1999 | Runk et al. | |
| 6,109,602 | A | 8/2000 | Schron, Jr. et al. | |
| 6,138,492 | A | 10/2000 | Vining et al. | |
| 6,151,951 | A | 11/2000 | Kawano | |
| 6,241,231 | B1 | 6/2001 | Schron, Jr. et al. | |
| 6,446,485 | B1 | 9/2002 | Tarasconi | |
| 6,450,004 | B1 | 9/2002 | Edmondson et al. | |
| 6,463,839 | B2 | 10/2002 | Ohtsuka et al. | |
| 6,467,327 | B1 | 10/2002 | Runk et al. | |
| 6,481,204 | B1 | 11/2002 | Yuschak et al. | |
| 6,494,075 | B1 | 12/2002 | Pelech, Jr. | |
| 6,522,953 | B1 | 2/2003 | Schneider | |
| 6,557,390 | B2 * | 5/2003 | Runk et al. | 72/482.1 |
| 6,564,611 | B2 | 5/2003 | Harrington et al. | |
| 6,644,090 | B2 | 11/2003 | Gasparini | |
| 6,732,564 | B2 | 5/2004 | Runk et al. | |
| 6,843,760 | B2 | 1/2005 | Akami et al. | |
| 6,848,291 | B1 | 2/2005 | Johnson et al. | |
| 6,928,852 | B2 | 8/2005 | Enderink | |
| 7,004,008 | B2 | 2/2006 | Harrington et al. | |
| 7,021,116 | B2 | 4/2006 | Harrington et al. | |
| 7,069,766 | B2 * | 7/2006 | Hayashi et al. | 72/481.3 |
| 7,096,708 | B2 | 8/2006 | Gascoin | |
| 7,152,453 | B2 * | 12/2006 | Johnson et al. | 72/481.1 |
| 7,296,457 | B2 | 11/2007 | Morehead et al. | |
| 7,308,817 | B2 * | 12/2007 | Shimota et al. | 72/482.1 |
| 7,596,983 | B2 | 10/2009 | Pabich et al. | |
| 2002/0023477 | A1 | 2/2002 | Gianelli | |
| 2003/0221476 | A1 | 12/2003 | Sperrer | |
| 2004/0163442 | A1 | 8/2004 | Gascoin | |
| 2004/0187552 | A1 | 9/2004 | Enderink | |

FOREIGN PATENT DOCUMENTS

| | | | |
|---|---|---|---|
| DE | 3136-440 | | 3/1983 |
| DE | 41 15 224 | A1 | 11/1992 |
| DE | 19513576 | | 10/1996 |
| DE | 19845386 | | 5/2000 |
| DE | 10054644 | | 5/2001 |
| EP | 0 119 108 | | 5/1987 |
| EP | 0 237 800 | | 9/1987 |
| EP | 0 256 245 | | 2/1988 |
| EP | 0 494 714 | A1 | 7/1992 |
| EP | 0 644 002 | A2 | 3/1995 |
| EP | 1169151 | | 12/2002 |
| EP | 1493506 | | 1/2005 |
| FR | 2122977 | | 1/1972 |
| FR | 2416064 | | 8/1979 |
| FR | 2598946 | | 11/1987 |
| JP | 57089929 | | 6/1982 |
| JP | 9100034 | | 4/1997 |
| JP | 10-323720 | | 12/1998 |
| JP | 2003 191016 | | 7/2003 |
| JP | 2003 200219 | | 7/2003 |
| RU | 741999 | | 6/1980 |
| WO | WO 02/13985 | | 2/2002 |
| WO | WO 02/092253 | | 11/2002 |
| WO | WO 2004/024361 | | 3/2004 |
| WO | WO2004024361 | A1 | 3/2004 |
| WO | WO 2004/101188 | | 11/2004 |

OTHER PUBLICATIONS

"New Standard Clamping" from www.wila.nl, printed Mar. 3, 2005 (four pages from www.wila.nl/English/clamping/ProductInfo_NS.htm; one page from www.wila.nl/images/dia-8-eng.gif; one page from www.wila.nl/images/dia-4-eng.gif; one page from www.wila.nl/images/dia-5-eng.gif; one page from www.wila.nl/images/diz-17-eng.gif, and four previously printed pages ("New Standard") from www.wila.nl.

International Search Report and Written Opinion, dated Jun. 22, 2006 for PCT Application No. PCT/US2006/003440, 12 pages.

An English-language abstract for AT 13832002.

An English-language abstract for DE 3136-440.

An English-language abstract for DE 19513576.

An English-language abstract for EP 0237800.

An English-language abstract for EP 0256245.

An English-language abstract for FR 2416064.

An English-language abstract for FR 2598946.

An English-language abstract for JP 09100034.

An English-language abstract for JP 57-089929.

An English-language abstract for WO 02/13985.

English-language abstract for RU741999 (Krutikov).

* cited by examiner

PRESS BRAKE TOOL SEATING TECHNOLOGY

RELATED APPLICATIONS

This application is a continuation-in-part of U.S. Ser. No. 11/053,134, entitled "PUSH PLATE TOOL HOLDER FOR PRESS BRAKE," filed Feb. 8, 2005 now U.S. Pat. No. 7,308, 817, the entire disclosure of which is incorporated herein by reference.

FIELD OF INVENTION

The present invention relates generally to industrial presses. More particularly, this invention relates to press brakes.

BACKGROUND OF THE INVENTION

Press brakes are commonly used to bend or otherwise deform sheet-like workpieces, such as sheet metal workpieces. A conventional press brake has an upper beam and a lower beam, at least one of which is movable toward and away from the other. Typically, the upper beam is movable vertically while the lower beam is fixed in a stationary position. It is common for a male forming punch and a female forming die to be mounted respectively on the upper and lower beams of a press brake.

Typically, the punch has a downwardly-oriented, workpiece-deforming surface (or "tip"). The configuration of this surface is dictated by the shape into which it is desired to deform a workpiece. The die typically has a recess, bounded by one or more workpiece-deforming surfaces, that is aligned with the tip of the punch. The configuration of this recess corresponds to the configuration of the punch's tip. Thus, when the beams are brought together, a workpiece between them is pressed by the punch into the die to give the workpiece a desired deformation (e.g., a desired bend).

In order to accurately deform a workpiece, it is necessary for the tools to be mounted securely on the tool holder. This is accomplished by forcibly clamping the tool holder about each tool. Multiple steps are sometimes required, for example, to mount a punch on the upper beam of a press brake. The punch may be moved into an initial-mount position by lifting the shank of the punch upwardly between a support plate and clamp of the tool holder. In some cases, when the punch is moved into this position, a safety key of the punch engages a safety slot of the tool holder. In other cases, a safety groove on the punch is engaged by a lip on the clamp of the tool holder. Either way, the tool holder subsequently is clamped forcibly on the shank of the punch. Even at this stage, the load-bearing surfaces of the tool holder and punch may not be securely engaged. Rather, additional steps may be required. For example, with many tool holder designs, the upper and lower tables of the press brake must subsequently be moved together until the punch comes into contact with a die on the lower table. By forcing the tip of the punch against the die, the punch can be urged upwardly relative to the tool holder until the load-bearing surface(s) of the punch is/are moved into contact with the corresponding load-bearing surface(s) of the tool holder. When a punch is in this operative position, the load-bearing surfaces of the tool holder and punch are engaged and the shank of the punch is clamped securely, e.g., between a support plate and clamp of the tool holder. During pressing operations, the punch is maintained in this position. Thus, it can be appreciated that several steps may be required to operatively mount a punch on the upper beam of a press brake.

It would be desirable to provide a tool holder that can be operatively clamped about a tool in such a way that the load-bearing surfaces of the tool holder and tool are engaged as an adjunct of the closing action of the tool holder on the tool (e.g., without having to press the tip of a preliminarily-clamped punch against a die on the lower table of the press brake). The present invention provides new press brake tool holder and tool technologies, which offer tool seating features and other advantages not found in other press brake tool holder systems.

SUMMARY OF THE INVENTION

Figure 1:
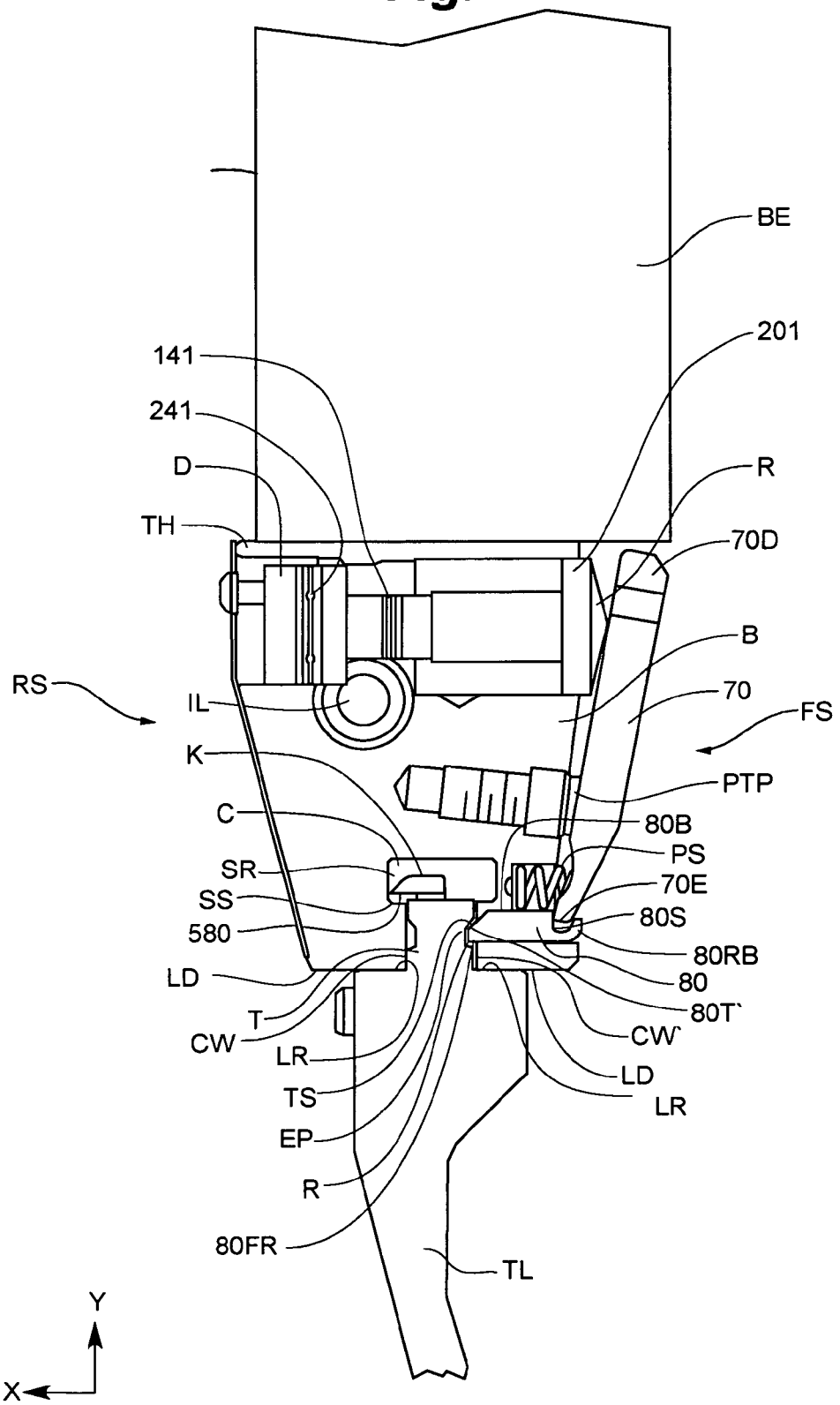
FIG. 1 is a broken-away schematic side view of a press brake tool holder, in combination with a press brake tool, in accordance with certain embodiments of the invention.

In certain embodiments, the invention provides a tool holder for a press brake. The tool holder is adapted to move a press brake tool along a pressing axis when the tool is operatively mounted on the tool holder. In the present embodiments, the tool holder comprises a tool-mount channel configured for receiving a tang of the tool, the tool-mount channel being bounded by two confronting walls of the tool holder. In the present embodiments, the tool holder also comprises a seating member mounted on a portion (optionally a stationary portion) of the tool holder so as to be moveable between an open position and a closed position. Preferably, a leading end region of the seating member extends into the tool-mount channel when the seating member is in its closed position. In the present embodiments, this leading end region of the seating member has at least one contact surface that is adapted to bear forcibly against a desired surface on the tang of the tool so as to deliver to the tool a force having a seating component that is at least generally parallel to the pressing axis. In the present embodiments, the tool holder includes a driver adapted for selective operation by actuating the driver at a desired time, in response to which the seating member moves to its open position, such movement optionally involving at least part of the seating member moving away from the tool-mount channel.

One group of embodiments provides a tool holder for a press brake, where the tool holder is adapted to move a press brake tool along a pressing axis (e.g., back and forth vertically along a vertical pressing axis) when the tool is operatively mounted on the tool holder. In these embodiments, the tool holder comprises a tool-mount channel configured for receiving a tang of the tool, the tool-mount channel being bounded by two confronting walls of the tool holder. In the present embodiment group, the tool holder is provided with a pivotable push plate mounted on the tool holder so as to be moveable pivotally between a first configuration and a second configuration, the thus mounted push plate having a pivot point at a desired location. The tool holder also includes a seating member mounted on a portion (optionally a stationary portion) of the tool holder so as to be moveable between an open position and a closed position. Preferably, a leading end region of the seating member extends into the tool-mount channel when the seating member is in its closed position. This leading end region of the seating member has at least one contact surface that is adapted to bear forcibly against a desired surface on the tang of the tool so as to deliver to the tool a force having a seating component that is at least generally parallel to the pressing axis. Preferably, the seating member is operably coupled with the pivotable push plate such that the seating member moves to its closed position in response to the push plate pivoting to its first configuration.

In some embodiments, the invention provides a tool holder for a press brake, and the tool holder is adapted to move a press brake tool along a pressing axis when the tool is operatively mounted on the tool holder. Here, the tool holder comprises a tool-mount channel configured for receiving a tang of the tool, the tool-mount channel being bounded by two confronting walls of the tool holder. In the present embodiments, a single block defines at least part of each of the two confronting walls, and this block houses an internal hydraulic chamber. The tool holder also includes a seating member mounted on a portion (optionally a stationary portion) of the tool holder so as to be moveable between an open position and a closed position. Preferably, a leading end region of the seating member extends into the tool-mount channel when the seating member is in its closed position. In the present embodiments, the leading end region of the seating member has at least one contact surface that is adapted to bear forcibly against a desired surface on the tang of the tool so as to deliver to the tool a force having a seating component that is at least generally parallel to the pressing axis. In the present embodiments, the tool holder has a hydraulic driver adapted for being operated by delivering hydraulic fluid into the internal hydraulic chamber in response to which the seating member moves relative to the noted portion (which optionally is a stationary portion) of the tool holder.

In one group of embodiments, the invention provides a method of operating a tool holder for a press brake, where the tool holder is adapted to move a press brake tool along a pressing axis when the tool is operatively mounted on the tool holder. In the present group of method embodiments, the tool holder comprises a tool-mount channel configured for receiving a tang of the tool, the tool-mount channel being bounded by two confronting walls of the tool holder. The tool holder also includes a seating member mounted on a portion (optionally a stationary portion) of the tool holder so as to be moveable between an open position and a closed position. Preferably, a leading end region of the seating member extends into the tool-mount channel when the seating member is in its closed position. In the present embodiments, the leading end region of the seating member has at least one contact surface that is adapted to bear forcibly against a desired surface on the tang of the tool so as to deliver to the tool a force having a seating component that is at least generally parallel to the pressing axis. The present method embodiments involve a hydraulic driver adapted for being operated by delivering hydraulic fluid into a hydraulic chamber of the driver in response to which the seating member moves relative to the noted portion (which optionally is a stationary portion) of the tool holder. The method comprises delivering such hydraulic fluid into the hydraulic chamber at a pressure of at least about 1,000 pounds per square inch.

In certain embodiments, the invention provides a tool holder for a press brake, the tool holder being adapted to move a press brake tool along a pressing axis when the tool is operatively mounted on the tool holder. In the present embodiments, the tool holder comprises a tool-mount channel configured for receiving a tang of the tool, the tool-mount channel being bounded by two confronting walls of the tool holder. In the present embodiments, the tool holder also comprises a push plate mounted on the tool holder so as to be moveable between a first configuration and a second configuration. Preferably, the push plate when in its first configuration is under a constant force that provides resistance to the push plate being moved out of its first configuration. In the present embodiments, the push plate is operably coupled to a driver adapted for selective operation by actuating the driver at a desired time so as to move the push plate to its second configuration. The tool holder also includes a seating member mounted on the tool holder so as to be moveable between an open position and a closed position. Preferably, a leading end region of the seating member extends into the tool-mount channel when the seating member is in its closed position. In the present embodiments, the leading end region of the seating member has at least one contact surface that is adapted to bear forcibly against a desired surface on the tang of the tool so as to deliver to the tool a force having a seating component that is at least generally parallel to the pressing axis. In the present embodiments, the seating member is operably coupled with the push plate such that when the push plate is in its first configuration the seating member is in its closed position and when the push plate is in its second configuration the seating member is in its open position. The tang of the tool preferably can be moved vertically into and out of the tool-mount channel when the seating member is in its open position.

Further, the invention provides a particular group of embodiments involving a press brake tool holder and a press brake tool, in combination. Here, the tool is operatively mounted on the tool holder. The tool holder has a tool-seating mechanism and is adapted to move the tool in a pressing direction during a pressing operation. In this group of embodiments, the tool comprises first and second ends, the first end defining a workpiece-deforming surface that is adapted for contacting a workpiece. The second end is defined by a tang. Preferably, the tang is provided with a resiliently-biased safety key having a retracted position and an extended position. Further, the safety key preferably is in its extended position and is resiliently biased against movement toward its retracted position. The tool also includes a load-receipt surface. The tool holder comprises a tool-mount channel in which is received the tool's tang, the tool-mount channel being bounded by two confronting walls of the tool holder. Preferably, at least one of the confronting walls defines a safety recess that is open to the tool-mount channel. In the present embodiments, an engagement portion of the tool's safety key is received in the safety recess. Here, the engagement portion of the safety key has a bottom surface that is located directly above a safety shelf of the tool holder, the bottom surface of the safety key's engagement portion being spaced above the tool holder's safety shelf. The tool holder in the present embodiments also includes a load-delivery surface, and the load-delivery surface is in direct contact with the tool's load-receipt surface. Further, the tool holder in the present embodiments includes a seating member mounted on, and for movement relative to, one of the two confronting walls of the tool holder. Preferably, the seating member is at least part of the tool-seating mechanism. In the present embodiments, at least part of the seating member is located in the tool-mount channel, and the seating member has a contact surface that is in direct contact with a desired surface on the tang of the tool. Preferably, the operatively-mounted tool has no externally-accessible actuator operably connected to the safety key to facilitate retracting the safety key from its extended position, and the tool holder preferably has no externally-accessible actuator that can be operated to retract the safety key of the operatively-mounted tool. The tool holder and tool are preferably configured such that the tool is prevented from being removed vertically from the tool-mount channel by pulling the tool in the pressing direction and/or by attempting to tilt the tool relative to the tool holder.

DETAILED DESCRIPTION OF PREFERRED EMBODIMENTS

FIG. 1 is a broken-away schematic side view of a brake press tool holder in combination with a press brake tool in accordance with certain embodiments of the invention. Generally, the tool holder TH defines a channel C configured for receiving the tang (or "shank") T of a press brake tool TL. This channel C is referred to herein as the tool-mount channel. In some embodiments, the tool-mount channel C has a generally T-shaped cross section, although this is by no means required. Preferably, the channel C is bounded by two confronting walls CW, CW' of the tool holder. In the illustrated embodiments, the confronting walls CW, CW' are generally or substantially vertical (and preferably define surfaces that are generally or substantially vertical and planar). Further, the illustrated embodiments provide a single block B that defines (at least part of) both of the confronting walls CW, CW'. In these embodiments, the block B can form all, substantially all, or only part of each wall CW, CW'. The optional features described in this paragraph are not required in all embodiments. For example, the configuration and construction of the wall(s) bounding the tool-mount channel C will vary depending upon the particular style in which the tool holder is embodied.

The tool holder will commonly be of the American style. However, the tool holder can take the form of various other press brake tool holder styles known in the art, including those currently in less widespread use. In fact, it will be appreciated that the tool holder TH can reflect any desired tooling style, including styles not yet developed, that would benefit from the features of this invention. The tool holder, of course, can be a press brake beam, an adapter mounted to a press brake beam, or any other type of press brake tool holder.

Certain embodiments of the invention provide a press brake tool holder in combination with a press brake tool. The tool TL can be a male forming punch or a female forming die. Typically, the tool TL has generally opposed first and second ends (or sides). Preferably, the first end (or side) of the tool defines a workpiece-deforming surface TP (e.g., at a tip of the tool) configured for making a desired deformation (e.g., a bend) in a workpiece when this surface TP is forced against the workpiece (e.g., when a tip of the tool is forced against a piece of sheet metal or the like). The second end (or side) of the tool has a tang T that is configured for being mounted in the tool-mount channel C, as will now be described.

The tang T of the tool TL is sized and shaped to be received in the tool-mount channel C. In some embodiments, such as where both confronting walls CW, CW' are stationary during the clamping action of the tool holder, a clearance gap is provided to facilitate mounting and dismounting the tang T in the channel C. In some cases, a lateral width (i.e., the width along the x axis) of the channel C is slightly greater than a corresponding lateral width of the tang T. Preferably, this gap is less than about 0.1 inch, and more preferably is less than about 0.05 inch, such as about 0.01 inch.

In some cases, the tool TL has a safety key K. As shown in FIGS. 1, 2, 5-9, 12B, 13, 14, 16, and 17, the tang T of the tool TL can optionally have a safety key K adapted for engaging a safety recess (or "safety groove") SR defined by the tool holder TH. When provided, the safety key K can be retractable or non-retractable. Safety keys of both types are described in U.S. Pat. No. 6,467,327 (Runk et al.), and U.S. patent application Ser. No. 10/742,439, entitled "Press Brake Tooling Technology", the entire contents of each of which are incorporated herein by reference.

In embodiments involving a tool TL with a safety key K, the key preferably comprises an engagement portion 580 that is adapted to project into a safety recess SR defined by the tool holder TH. In the case of a non-retractable safety key, the key will typically comprise a rigid projection from the tool's tang. When provided, the non-retractable safety key preferably is either integral to the tool's tang or rigidly joined to the tool's tang.

In the case of a retractable safety key, the key is mounted on the tool so as to be moveable between an extended position and a retracted position. In more detail, such a key preferably comprises a rigid engagement portion that is moveable relative to (e.g., generally toward and away from) the tool's tang. Such retractable safety keys are described in U.S. Pat. No. 6,467,327 and U.S. patent application Ser. No. 10/742,439. In some cases, the safety key is part of a key assembly (e.g., mounted inside and/or on the tool) comprising at least one spring member resiliently biasing the key toward its extended position.

Figure 16:
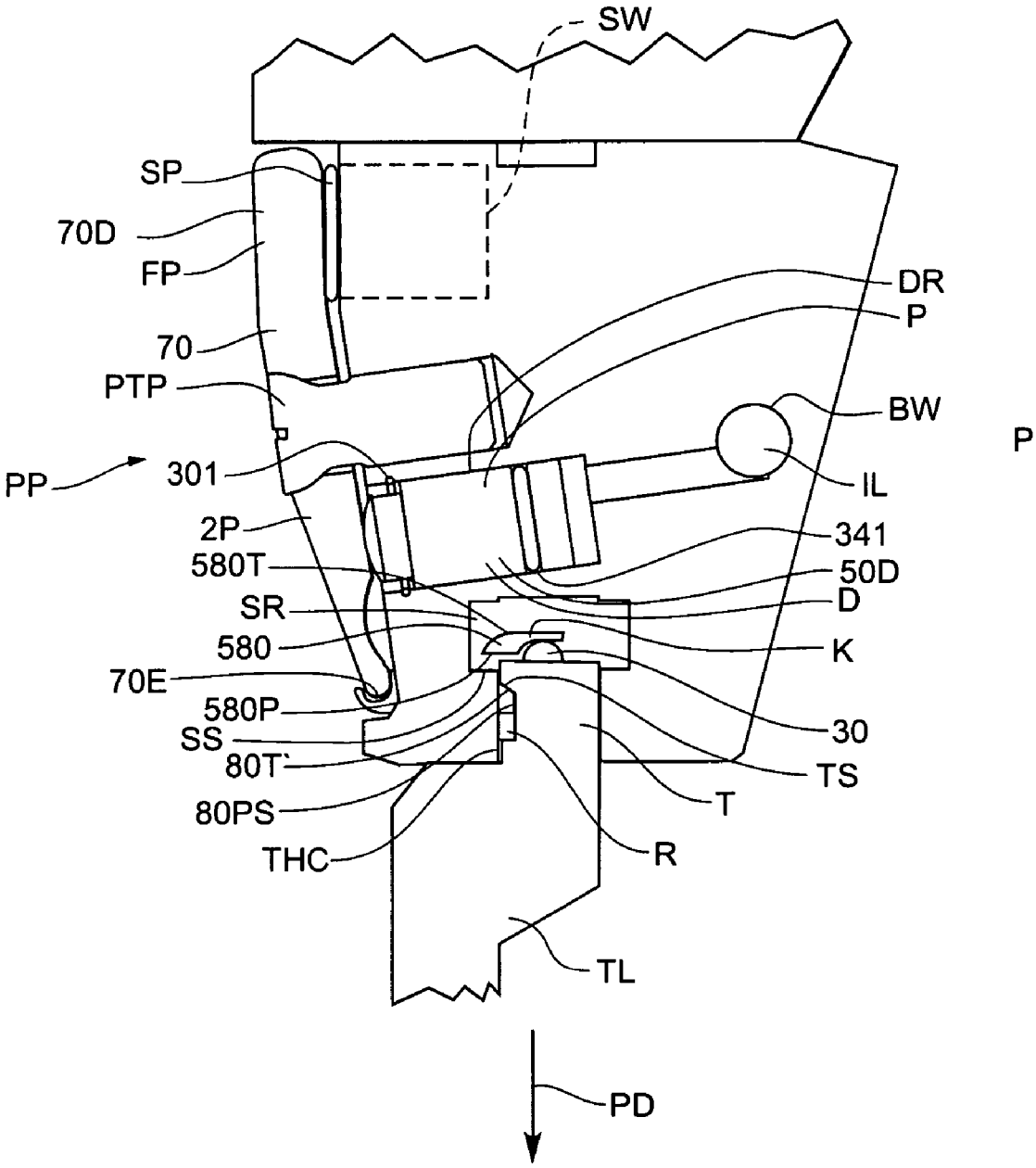
FIG. 16 is a partially broken-away schematic side view of a press brake tool holder, in combination with a press brake tool, in accordance with certain embodiments of the invention.
Figure 17:
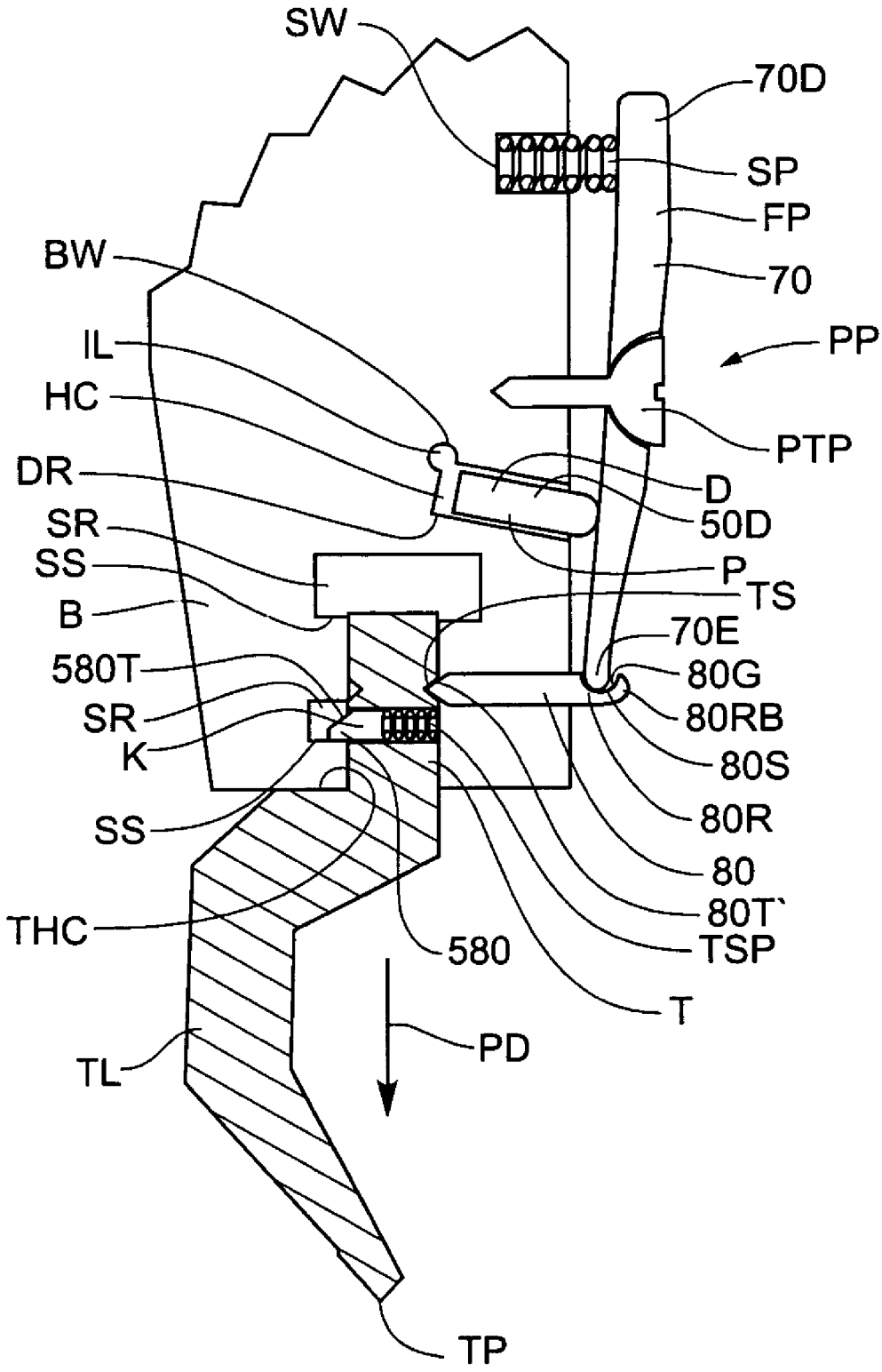
FIG. 17 is a partially broken-away schematic side view of a press brake tool holder, in combination with a press brake tool, in accordance with certain embodiments of the invention.

In one group of embodiments, the press brake tool TL has a click-in/slide-out design. Reference is made to FIGS. 16 and 17. Here, a safety key K is mounted on the tool's tang T such that the key (or at least an engagement portion thereof) is moveable between an extended position and a retracted position. The tool TL in these cases is devoid of any button or other actuator (for retracting the safety key) that is externally accessible to an operator once the tool has been mounted on the tool holder. In FIGS. 16 and 17, the tool holder is devoid of any externally-accessible actuator that could be operated to retract the safety key K of the mounted tool TL. Click-in/slide-out tools are detailed in U.S. patent application Ser. No. 10/742,439. The teachings of this '439 application concerning the structure, function, and other details and features of various click-in/slide-out tool designs are hereby incorporated by reference.

In FIGS. 16 and 17, it can be appreciated that each tool TL has a safety key K with a click-in/slide-out configuration. For example, the engagement portion 580 of the safety key K has a tapered leading surface 580T that facilitates advancing the tools' tang T into the tool holder's channel C. This tapered surface 580T can be slanted, or radiused or otherwise curved. Preferably, when the tool's tang T is moved toward the tool holder's channel C, the tapered leading surface 580T of the safety key's engagement portion 580 engages, and cams with, a corner THC of the tool holder (which corner preferably bounds one side of the channel C), such that the resulting camming action causes the safety key to move to its retracted position, which allows continued movement of the tool's tang into the channel C at least until the engagement portion of the safety key comes into alignment with (i.e., reaches the same elevation as) a safety recess SR of the tool holder, at which point the engagement portion of the safety key moves (e.g., by virtue of a compression spring bearing forcibly against, and thereby moving, the safety key) into the safety recess. At this stage, the illustrated tool TL is restrained against being removed vertically (or falling) from the tool holder TH due to the engagement of the safety key K and a safety shelf SS (which bounds the safety recess) of the tool holder. In more detail, the engagement portion 580 of the illustrated safety key K has a planar trailing surface 580P. This planar surface 580P prevents the tool's tang T from being removed vertically from the tool holder's channel C once the safety key's engagement portion 580 has been engaged with (i.e., moved into) the safety recess SR. In FIGS. 16 and 17, it can be appreciated that attempting to move the mounted tool (relative to the tool holder) in the press direction PD will not result (even after releasing the clamping force on the tool) in any surface of the safety key's engagement portion camming with the safety shelf (or any other surface of the tool holder) in such a way that the safety key is caused to retract. Rather, once the tool's tang is mounted in the tool holder's channel with the engagement portion of the safety key positioned in the tool holder's safety recess, the configuration of the trailing surface (s) of the safety key's engagement portion together with the configuration of the tool holder's safety shelf (and any other tool holder surface the safety key may contact) prevent vertical removal of the tool's tang from the channel C. Thus, the present embodiments are designed to assure that the tool is only removed by sliding it horizontally out of the tool holder's channel.

With continued reference to FIGS. 16 and 17, it can be appreciated that the engagement portion 580 of the safety key K on a click-in/slide-out tool can be provided in different forms. Preferably, the trailing surface(s) of such an engagement portion is/are configured to prevent vertical removal of the mounted tool from the tool holder's channel. For example, the trailing surface(s) preferably is/are not radiused or slanted. Conjointly, the safety shelf of the tool holder preferably is not radiused or slanted. In FIGS. 16 and 17, the engagement portion 580 of the safety key has a planar trailing surface 580T, and the tool holder's shelf SS is a planar surface. Here, the illustrated safety shelf SS is an upward-facing, horizontal surface, although this is not required. Conjointly, in FIGS. 16 and 17, the trailing surface of the safety key's engagement portion 580 is a downward-facing, horizontal surface 580P. These features, however, are merely representative of certain exemplary embodiments. In FIGS. 16 and 17, the tool holder TH is part of, and/or is on, the upper beam of a press brake. Alternatively, the tool holder can be part of, and/or can be on, the lower beam of a press brake.

Thus, the click-in/slide-out embodiments of the invention preferably involve a tool holder and tool in a combination wherein the tool holder and tool have particular configurations. In these embodiments, the tool and tool holder are configured such that once the tool is mounted (even loosely) in the channel with the safety key's engagement portion 580 received in the tool holder's safety recess SR, the tool is prevented from being removed vertically from the channel by pulling on and/or attempting to tilt the mounted tool. Insofar as the tool is concerned, a safety key K on the tool preferably has an engagement portion 580 with a particular configuration. Insofar as the tool holder is concerned, a safety recess SR of the tool holder preferably has a particular configuration and/or a safety shelf SS of the tool holder preferably has a particular configuration. These portions of the tool holder and tool desirably are configured such that if the clamping force and/or clamping element(s) of the tool holder is/are released (e.g., such that the tool is only prevented from falling out of the channel C by virtue of the safety key's engagement portion 580 resting on the safety shelf SS or another surface of the tool holder), the safety key remains engaged with the safety recess and/or the safety shelf even if a press brake operator pulls on (e.g., in the pressing direction) the tool and/or attempts to tilt the tool. As noted above, one manner of achieving this feature is to provide the tool holder with a horizontal safety shelf SS and to provide the tool's safety key with a horizontal trailing surface 580P. Given the present teaching as a guide, of course, skilled artisans will be able to select other configurations (not requiring such horizontal surfaces) that would prevent vertical removal of the mounted tool. For example, the trailing surface(s) of the safety key's engagement portion and/or the tool holder's safety shelf could be tapered in such a way that they would not cam together so as to retract the safety key if an operator were to pull the loosely mounted tool in the pressing direction PD>

In certain embodiments, the tool holder TH has a safety shelf SS that is at least generally, or at least substantially, horizontal. With reference to FIGS. 16 and 17, it can be appreciated that the safety recess SR can optionally be bounded by one vertical surface extending between two horizontal surfaces. The safety recess SR, however, can take many different configurations. Moreover, the safety recess may be omitted entirely in some cases.

Thus, in some embodiments, the tool holder defines a safety recess SR. When provided, the safety recess SR preferably is sized to receive an engagement portion 580 of a desired safety key K. In some embodiments involving a tool holder TH in combination with a press brake tool TL, the tool holder TH has a safety recess SR at a location on the tool holder TH that is aligned with (e.g., is at the same elevation as) a safety key K on the tool TL. For example, some embodiments of this nature (such as those shown in FIGS. 1, 2, 5, 7, 9, 12B, 14, 16, and 17) provide a tool TL having a safety key K projecting generally away from the tang T of the tool and engaged with (e.g., extending into) a safety recess SR defined by the tool holder, such that an engagement portion 580 of the safety key is received in the safety recess SR (and/or is positioned directly above a safety shelf SS of the tool holder).

Thus, some embodiments of the invention provide a tool holder and tool in combination. Reference is made to FIGS. 1, 2, 5, 7, 9, 11, 12A, 12B, 14, 16, 17, and 18. In these embodiments, the second end of the tool has a tang T that is received in the tool holder's channel. As noted above, the channel C is typically bounded by two confronting walls CW, CW' of the tool holder. In the present combination embodiments, the tool's first end (which typically defines a tip) preferably projects (e.g., generally vertically, optionally downwardly) away from the tool holder.

Typically, the tool holder TH has at least one load-delivering surface LD configured for engaging a load-receiving surface LR of a press brake tool TL. Preferably, the tool holder TH has one or more generally or substantially horizontal load-delivering surfaces LD each being adapted to engage and deliver force to (when the tool is operatively mounted on the tool holder) one or more corresponding generally or substantially horizontal load-receiving surfaces LR of the tool TL. In some embodiments involving a tool in combination with a tool holder, the tool holder has a load-delivering surface LD engaged with (e.g., carried directly against) a load-receiving surface LR of the tool TL. Preferably, these engaged surfaces LD and LR are generally or substantially horizontal. In some cases, the tool holder TH has two horizontal load-delivering surfaces LD. For example, FIGS. 1-14 and 16-19 depict tool holders of this nature, wherein two load-delivering surfaces LD are separated by an opening of the tool-mount channel C. Here, the channel C is depicted as being downwardly open. However, the invention also provides embodiments wherein the channel C is upwardly open (e.g., embodiments wherein the tool holder is used to secure a die on the lower beam of a press brake).

Each illustrated load-delivering surface LD of the tool holder TH is configured for engaging, and delivering force to, a corresponding load-receiving surface LR of a tool TL. In the figures, each horizontal load-delivering surface LD of the tool holder TH is shown as being a downwardly-facing surface, and each horizontal load-receiving surface LR of the tool is shown as being an upwardly-facing surface. In other embodiments (e.g., where the tool holder is on a lower beam), the horizontal load-delivering surface(s) LD of the tool holder is/are upwardly facing, and the horizontal load-receiving surface(s) of the tool is/are downwardly facing. Thus, the invention provides various combination embodiments wherein the tang of a tool is operatively mounted in the channel of the tool holder such that each load-delivering surface of the tool holder is generally or substantially horizontal and is carried directly against a corresponding generally or substantially horizontal load-receiving surface of the tool.

In certain embodiments, the tool holder TH is adapted for forcing the tool TL (e.g., when the tool is operatively mounted on the tool holder) against a workpiece by delivering force from the load-delivering surface(s) LD of the tool holder to the load-receiving surface(s) LR of the tool. In preferred embodiments of this nature, the tool holder TH is adapted for moving the operatively-mounted tool TL along a pressing axis PA (shown in FIG. 5), e.g., during a pressing operation. For example, the tool holder TH can optionally be adapted for moving the tool TL in a pressing direction PD (shown in FIG. 12B) that is generally or substantially normal to the load-delivering surface(s) LD of the tool holder. In preferred embodiments of this nature, each load-delivering surface LD of the tool holder TH is generally or substantially horizontal, and the tool holder is adapted for moving the tool TL in a generally or substantially vertical direction. Thus, the tool holder TH in these embodiments is adapted for moving the tool TL vertically into and out of engagement with a workpiece WP (e.g., when the workpiece is secured in a working position between the upper and lower tables of the press brake).

In some embodiments, the tool holder is operably coupled to a press brake ram that is adapted for moving the tool holder and the operatively-mounted tool together so as to force the workpiece-deforming surface TP of the tool TL against a workpiece WP. Preferably, the ram (which can be part of, or otherwise operably coupled with, a bed BE of the press brake) is adapted for moving the tool holder TH and the tool TL together in a pressing direction that is generally or substantially normal to the load-delivering surface(s) LD of the tool holder (e.g., in a vertical direction). In other embodiments, the tool holder is not adapted for moving the operatively-mounted tool, but rather is designed for securing the operatively-mounted tool in a stationary position during pressing operations.

Figure 2:
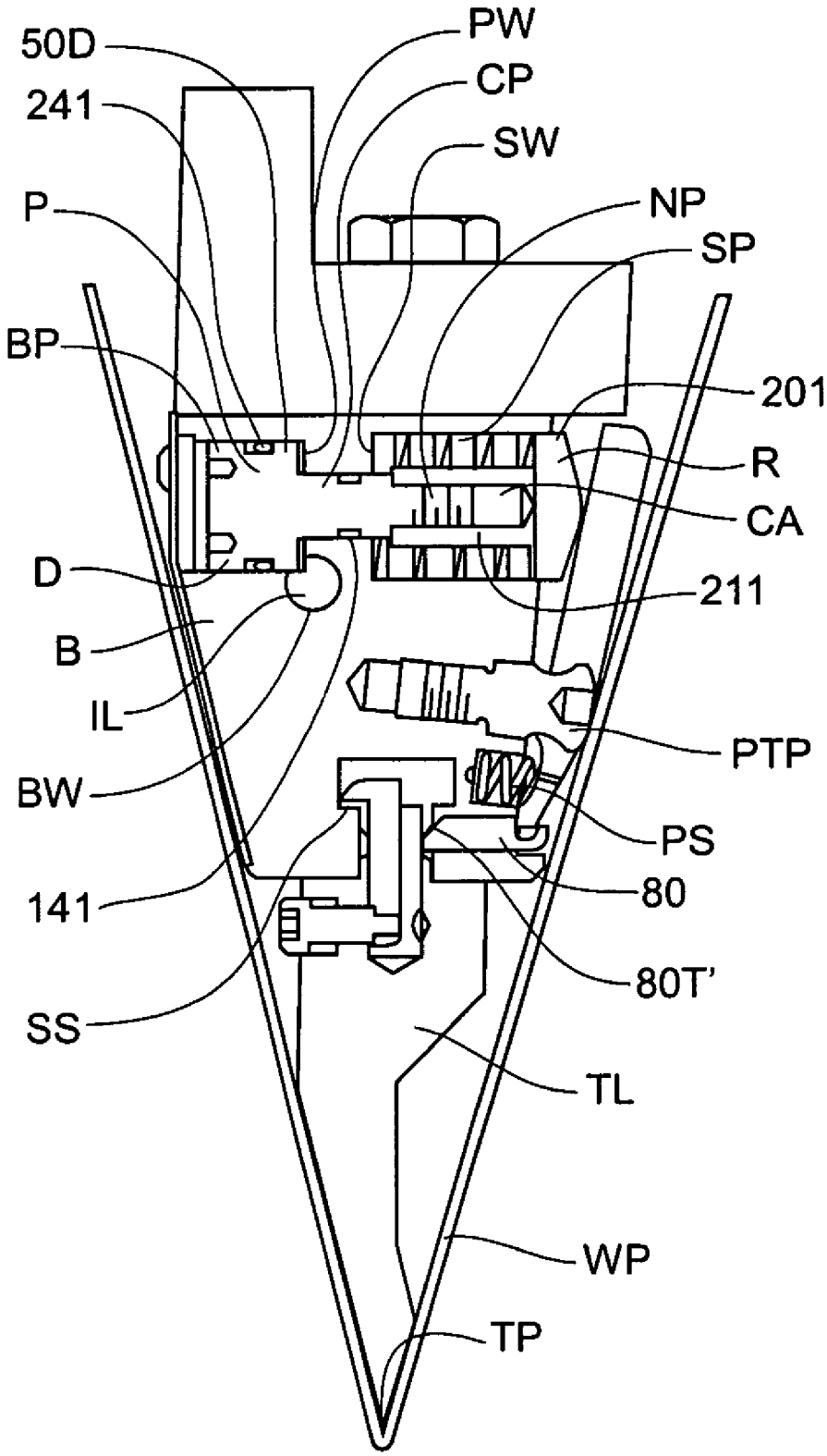
FIG. 2 is a schematic side view of a press brake tool holder, in combination with a press brake tool and a workpiece, in accordance with certain embodiments of the invention.
Figure 3:
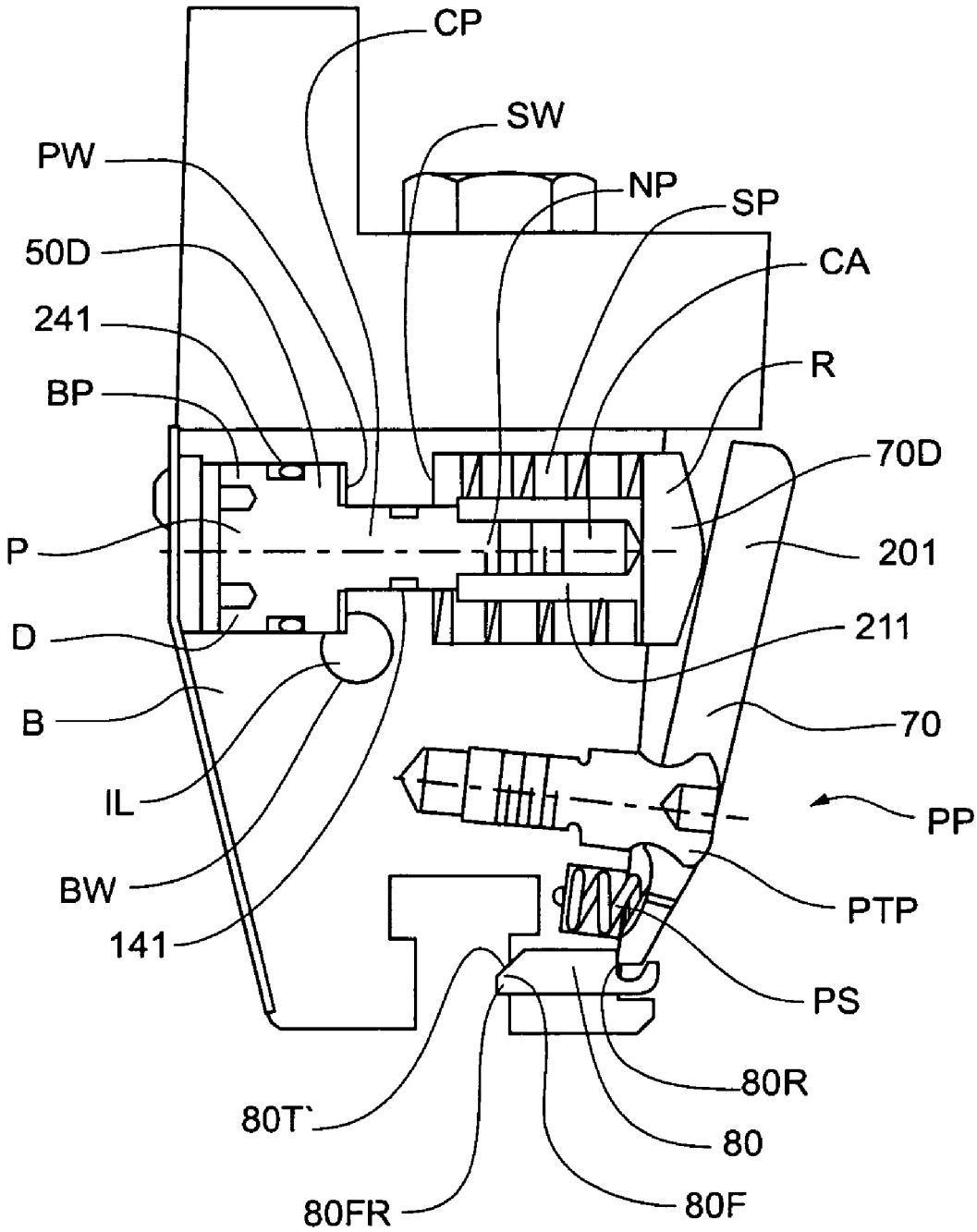
FIG. 3 is a schematic side view of a press brake tool holder in accordance with certain embodiments of the invention.
Figure 4:
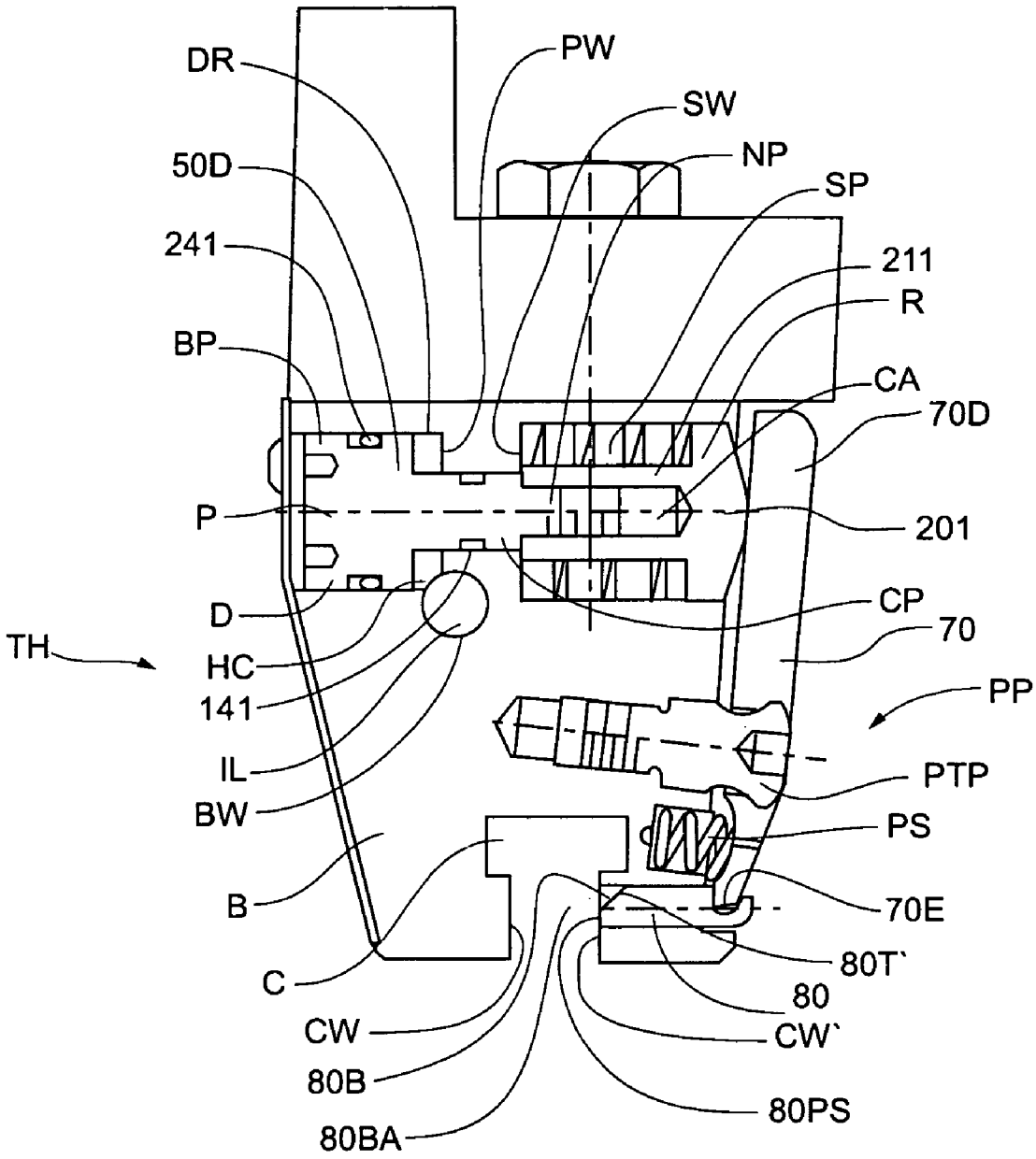
FIG. 4 is a schematic side view of a press brake tool holder in accordance with certain embodiments of the invention.
Figure 5:
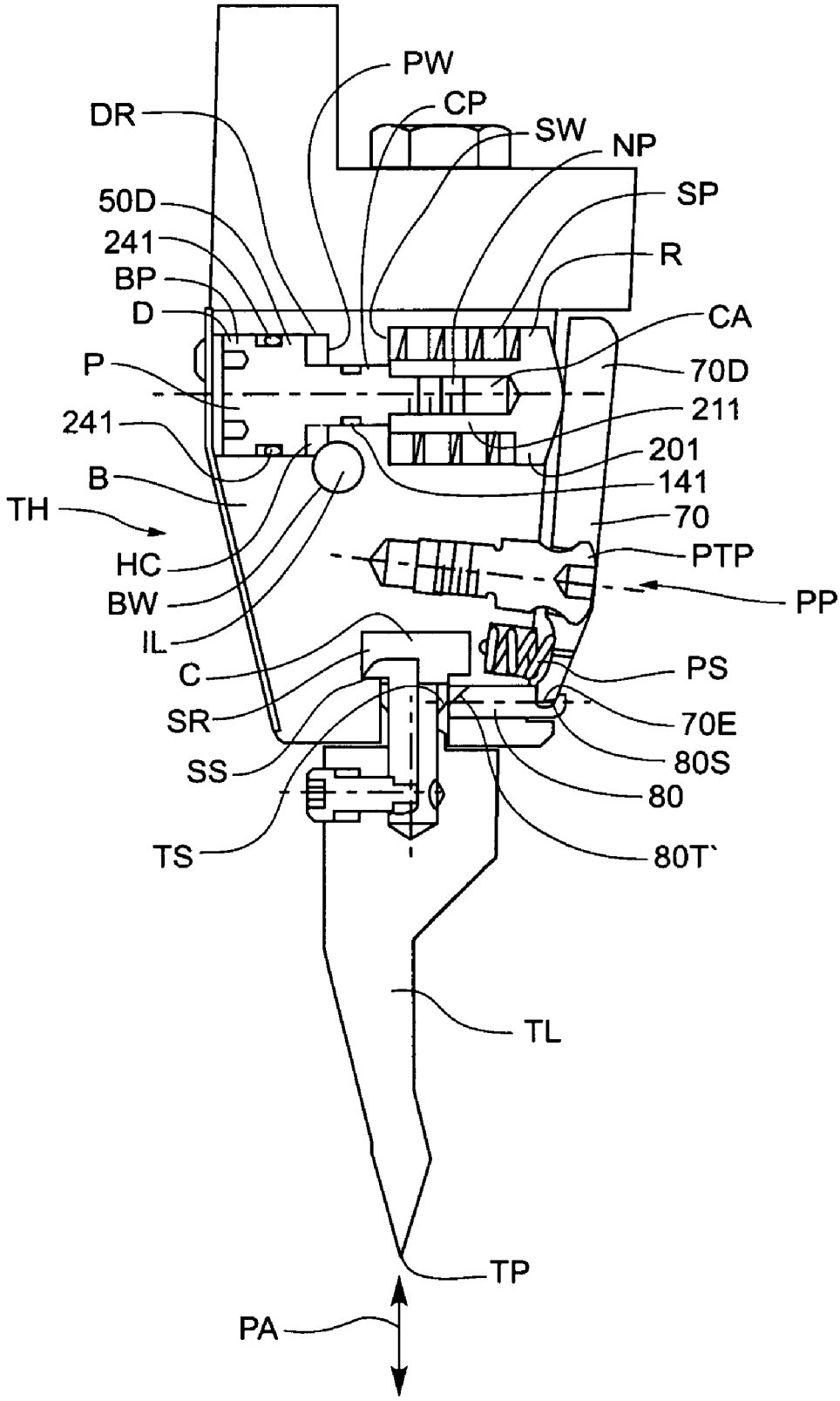
FIG. 5 is a schematic side view of a press brake tool holder, in combination with a press brake tool, in accordance with certain embodiments of the invention.
Figure 6:
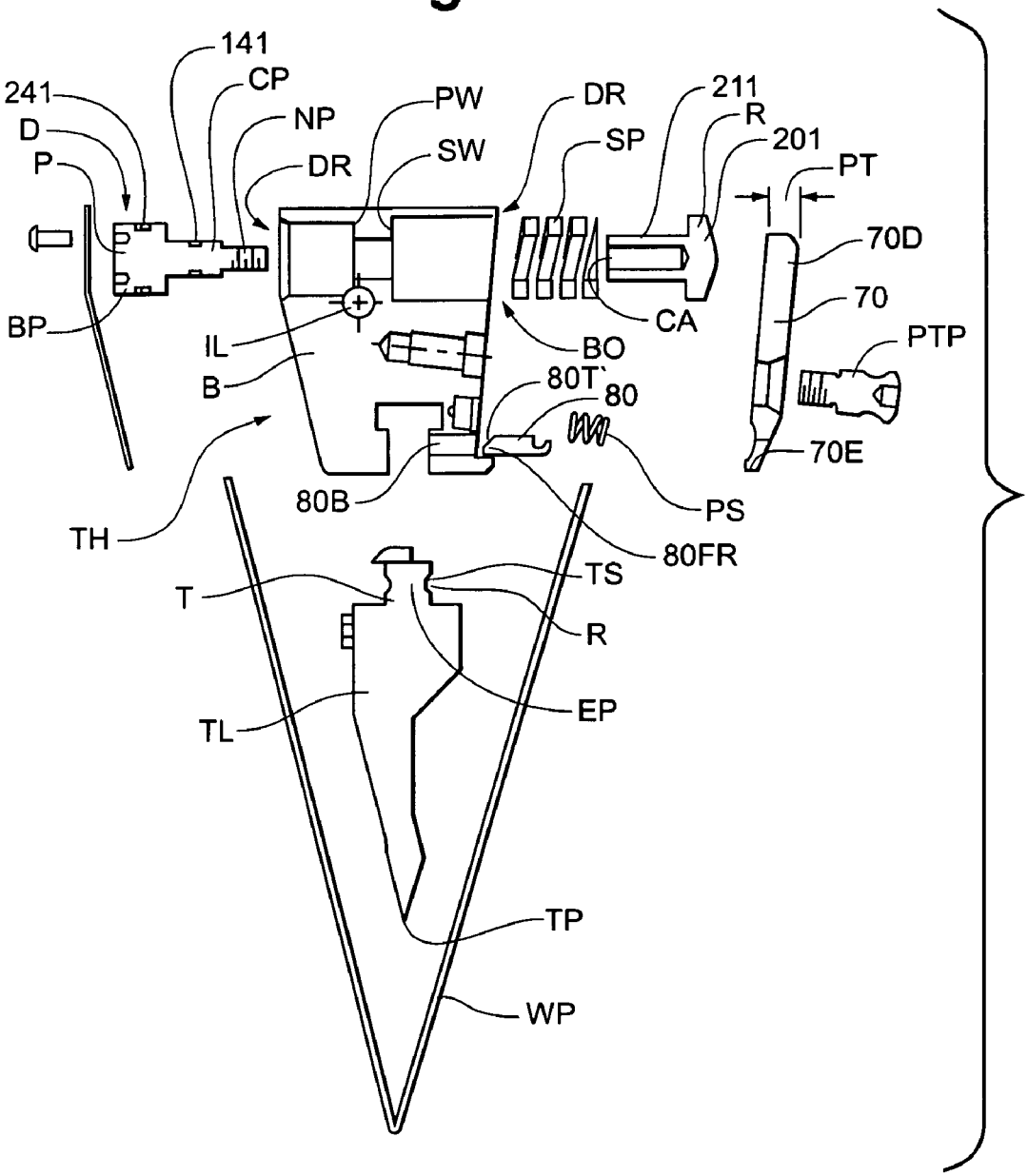
FIG. 6 is an exploded side view of the combination shown in FIG. 2.
Figure 7:
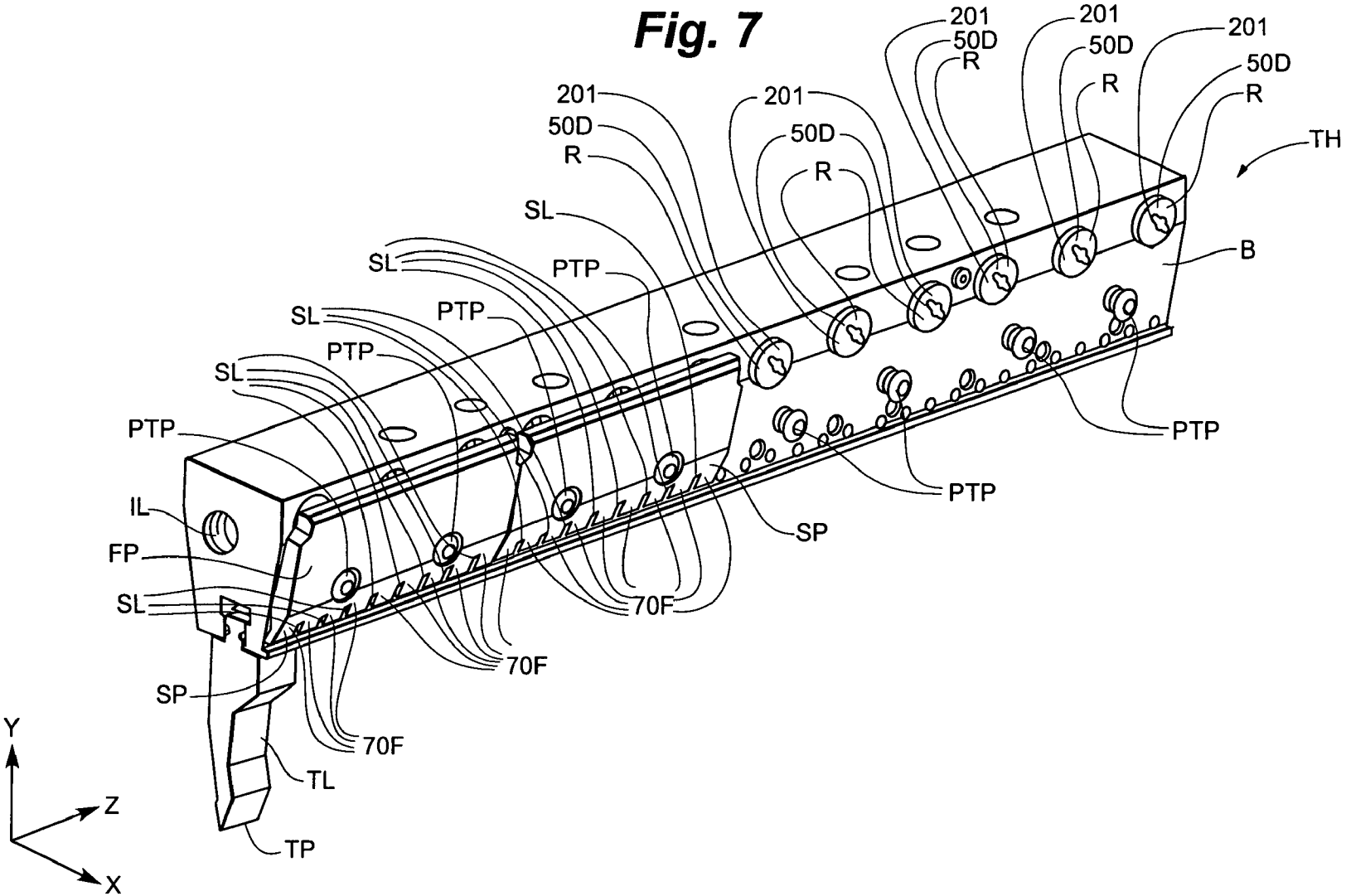
FIG. 7 is a schematic perspective view of a press brake tool holder, in combination with a press brake tool, in accordance with certain embodiments of the invention.

Preferably, the tool holder TH has a closed configuration and an open configuration. When the tool holder TH is in its open configuration, the tang T of a press brake tool TL can be readily moved into and out of the tool holder's channel C. Reference is made to FIGS. 4, 5. and 19. When the tool holder TH is in its closed configuration, the tang T of a tool TL mounted in the tool holder's channel C is clamped securely (and held rigidly) against a wall CW of the tool holder. Reference is made to FIGS. 1-3, 7, 9, 10, 11, 12B, 14, 16, 17, and 18.

In the illustrated embodiments, the tool holder TH includes at least one seating member (or "pusher member") 80. Preferably, the seating member 80 is mounted on the tool holder TH (optionally, on a stationary portion of the tool holder) so as to be moveable between an open position and a closed position. FIGS. 4 and 5 illustrate the open position of an exemplary seating member 80, and FIGS. 1-3 illustrate the closed position of this seating member 80. These figures exemplify a broader group of embodiments wherein the seating member 80 is moveable generally or substantially (in some cases without any substantial vertical movement) horizontally between its open and closed positions. This feature, however, is by no means required. For instance, the tool holder can optionally include a seating member that is moveable horizontally and vertically relative to the portion of the tool holder on which it is mounted. The illustrated seating members 80 are slidably moveable (e.g., axially) relative to the portion of the tool holder on which each seating member is mounted (e.g., toward and away from the channel).

Preferably, a leading end region (or "clamping end region") 80FR of the seating member 80 extends into the tool-mount channel C when the seating member is in its closed position. This can be seen, for example, in FIG. 1. In the illustrated embodiments, the leading end region 80FR of the seating member 80 does not project into the channel C (or does not project so far as to prevent the tang of a press brake tool from being readily moved vertically into and out of the channel) when the seating member 80 is in its open position. Preferably, when the seating member 80 is in its open position, the leading end region 80FR of the seating member is retracted (entirely, at least substantially entirely, etc.) in a bore 80B extending through the body B of the tool holder.

In certain embodiments, the seating member extends into the tool-mount channel whether the seating member is in its closed position or its open position. In these embodiments, the seating member extends into the channel to a lesser extent when in the open position than when in the closed position.

Preferably, the seating member 80 comprises (e.g., is) a rigid body having generally-opposed front 80F and rear 80R ends (or sides). While not required in all embodiments, the seating member shown in the drawings is mounted on a stationary portion of the tool holder's body B. That is, the portion of the tool holder on which the seating member is mounted is not moved laterally (at least not substantially) during the closing action of the tool holder.

The illustrated seating member 80 is mounted slidably in a bore 80B extending through the tool holder's body B, which preferably defines the noted stationary portion of the tool holder. In some embodiments, this body B also defines at least part of each of the two confronting walls CW, CW' (and/or an optional hydraulic reservoir for an actuator of the tool holder). In preferred embodiments of this nature, the body B is a single, integral block, desirably formed of a rigid material, such as metal (e.g., steel). The bore 80B can optionally extend along an axis that is generally or substantially perpendicular to the pressing axis PA of the tool holder. This orientation of the bore 80B, however, is by no means required.

In the illustrated embodiments, the seating member 80 is mounted in the bore 80B so as to be slidably moveable along the axis of the bore 80B. This axis 80BA is shown as being substantially horizontal, although this is not required. In certain embodiments, the bore 80B opens through one CW' of the confronting walls CW, CW' bounding the tool-mount channel C. That is, the bore 80B in such embodiments opens into the channel C.

In the illustrated embodiments, the bore 80B has a first outlet that opens through a desired one CW' of the confronting walls CW, CW', and the leading end region 80FR of the seating member 80 projects from this outlet (and into the channel C) when the seating member 80 is in its closed position. The illustrated bore 80B also has a second outlet from which a trailing end region of the seating member projects when the seating member is in its closed position. The second outlet preferably opens through a wall (or a wall surface) that is generally opposed to the desired one CW' of the confronting walls CW, CW'. In other words, these first and second outlets preferably open through walls (or wall surfaces) that are generally opposed. This feature, however, is strictly optional.

Figure 15:
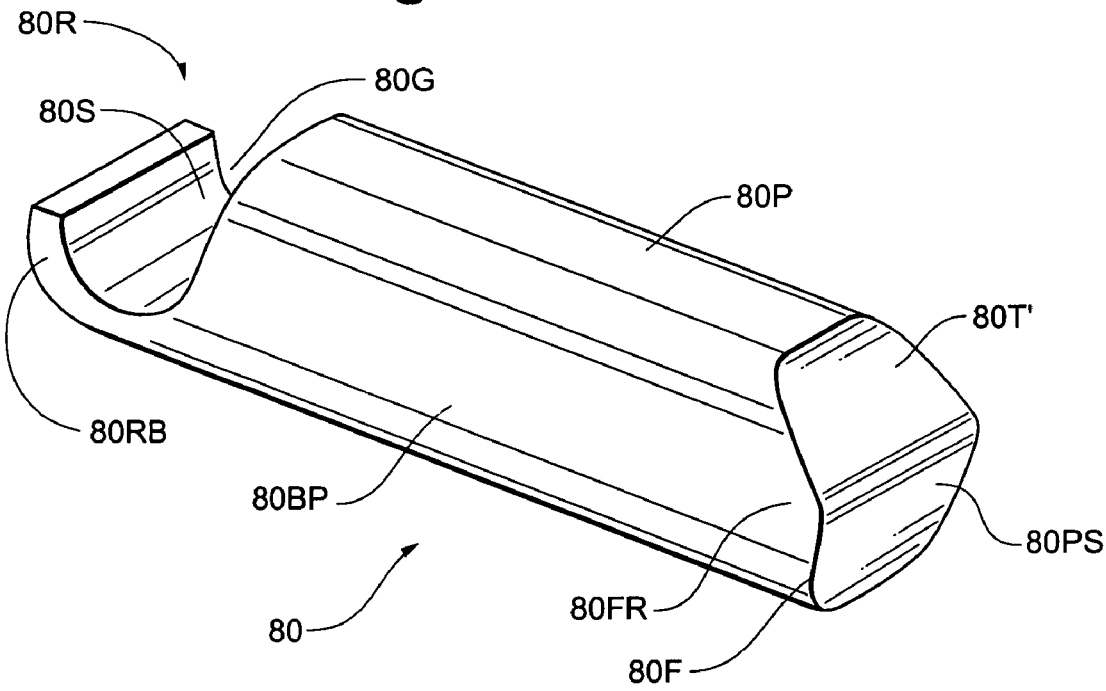
FIG. 15 is a perspective view of a seating member that can be used with a press brake tool holder in accordance with certain embodiments of the invention.

Thus, the seating member 80 preferably comprises a rigid body. In some embodiments, this rigid body has a generally cylindrical configuration. An exemplary embodiment of this nature is shown in FIG. 15. Here, the seating member 80 is a pin-like member, which desirably is mounted in the bore 80B so as to be moveable (e.g., slidably) toward and away from the tool-mount channel C. Preferably, the seating member 80 moves axially away from the channel C in response to actuation of an optional driver D, as described below.

In some cases, it is advantageous to provide the seating member 80 with at least one planar side surface 80P. This can facilitate mounting the seating member in a correspondingly configured bore for axial movement without rotation (e.g., so the seating member stays in a substantially constant rotational orientation while moving axially in such bore). This can also be achieved by mechanically linking the seating member 80 to a push plate 70, as described below. In either fashion, the seating member can be maintained in a particular orientation (e.g., such that a taper surface 80T' of its leading end region is in a generally upwardly-facing orientation).

The leading end region 80FR of the seating member 80 preferably has at least one contact surface (e.g., a taper surface 80T', a planar surface 80PS, and/or a corner surface) that is adapted to bear forcibly against a desired surface (optionally a taper surface TS) on the tang of a tool (which optionally has a predetermined tang configuration) so as to deliver to the tool a force having a seating component that is at least generally parallel to the pressing axis. Preferably, the seating component of this force moves the tool relative to the tool holder until the load-bearing surfaces LD, LR of the tool and tool holder are brought into contact with each other. Different embodiments of the invention achieve tool seating in different ways.

The exemplary seating member 80 in FIG. 15 is an elongated pin (e.g., a sliding pin). Pins of various configurations can be used. In the illustrated embodiments, a generally cylindrical pin is used. In other embodiments, a generally rectangular pin is used. Many other configurations can be used. Moreover, the seating member 80 need not be a pin. Rather, the seating member can be a block, a rigid frame, etc.

With continued reference to FIG. 15, the illustrated seating member 80 has a leading end region 80FR that is tapered. Thus, the leading end region 80FR of this particular seating member 80 defines at least one taper surface 80T'. In certain embodiments of this nature, the leading end region 80FR of the seating member 80 also defines at least one planar surface 80PS. This may be advantageous if the tool holder is used with a traditional American-style tool, or any other tool, that simply has a planar engagement portion EP.

In FIG. 15, the leading end region 80FR of the seating member 80 has a taper surface 80T' extending away from a planar surface 80PS. This planar surface 80PS is defined by the leading end 80F of the illustrated seating member. In more detail, this exemplary leading end region 80FR has a taper surface 80T' on one side of the planar surface 80PS, but not on the opposite side. In some cases, the taper surface 80T' will be oriented generally upwardly when the seating member 80 is in its assembled position on the tool holder TH. These features, while being advantageous, are not required.

In other embodiments, the leading end region of the seating member 80 is not tapered, but the tool holder is provided in combination with a press brake tool the tang of which has an engagement portion EP with a taper surface TS against which the leading end region 80FR of the seating member is adapted to bear so as to deliver to the tool a force with a seating component that moves the tool (e.g., upwardly) so as to bring the load-receiving surface(s) of the tool into direct contact with the load-delivering surface(s) of the tool holder.

Thus, in embodiments where the tool holder TH is adapted for moving a tool along a pressing axis (e.g., during a pressing operation), the seating member 80 optionally is adapted for delivering to such a tool a force having both a seating component and a clamping component. In some embodiments of this nature, the seating component is generally parallel to the pressing axis PA, and the clamping component is generally perpendicular to the pressing axis. As noted above, the seating component can optionally be vertical (e.g., upward), while the clamping component is horizontal.

Figure 8:
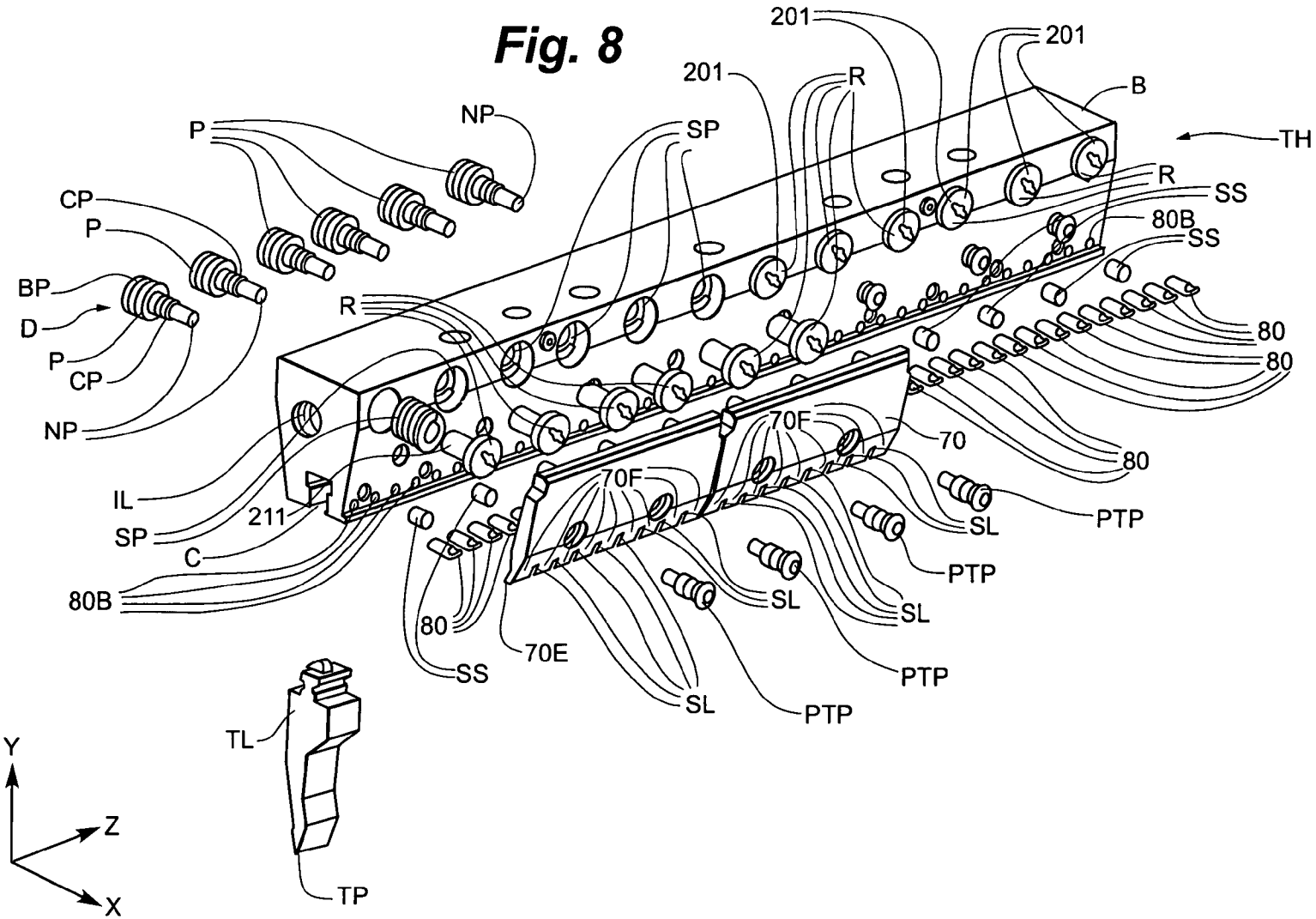
FIG. 8 is an exploded perspective view of the combination shown in FIG. 7.
Figure 9:
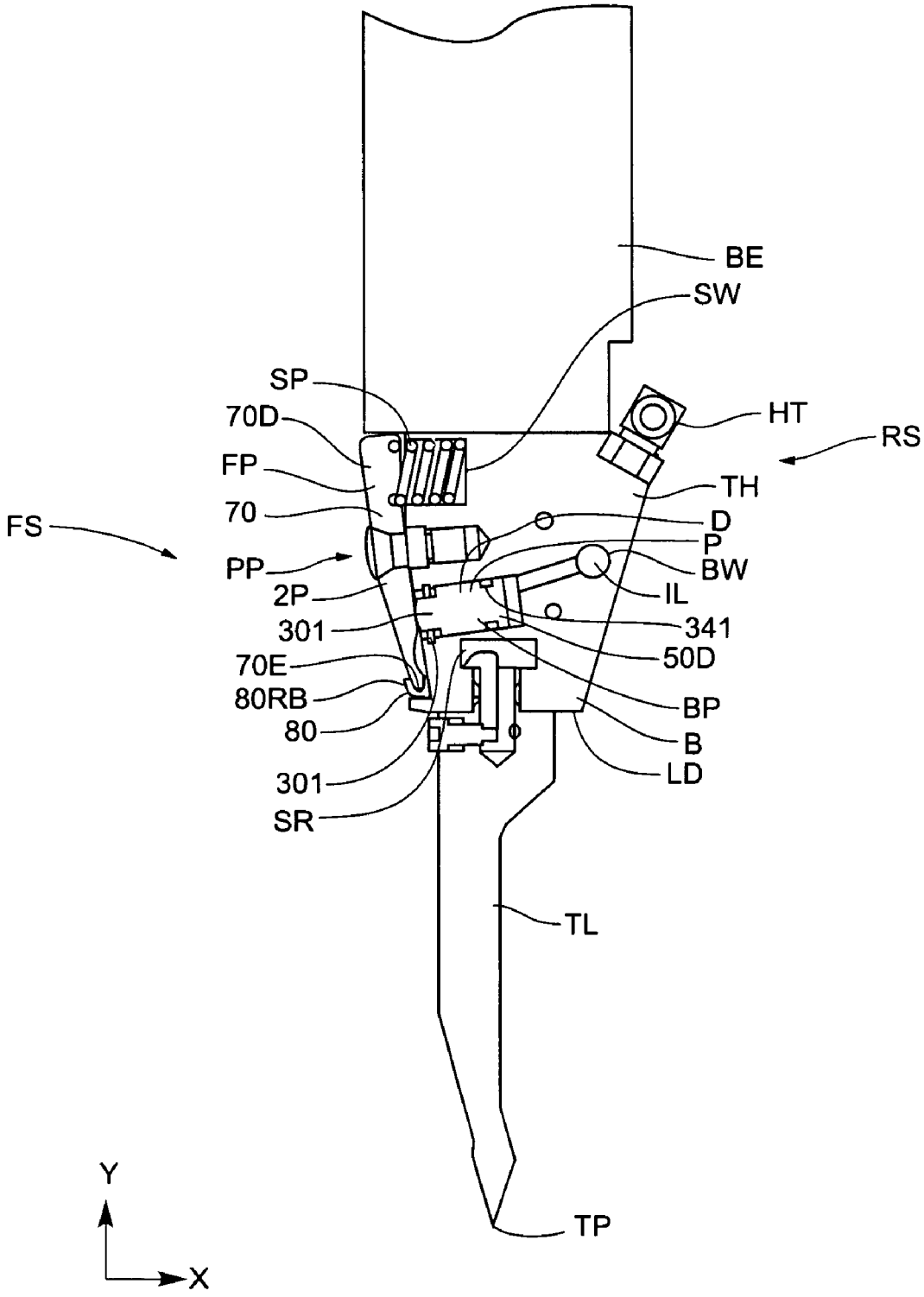
FIG. 9 is a partially broken-away schematic side view of a press brake tool holder, in combination with a press brake tool, in accordance with certain embodiments of the invention.
Figure 10:
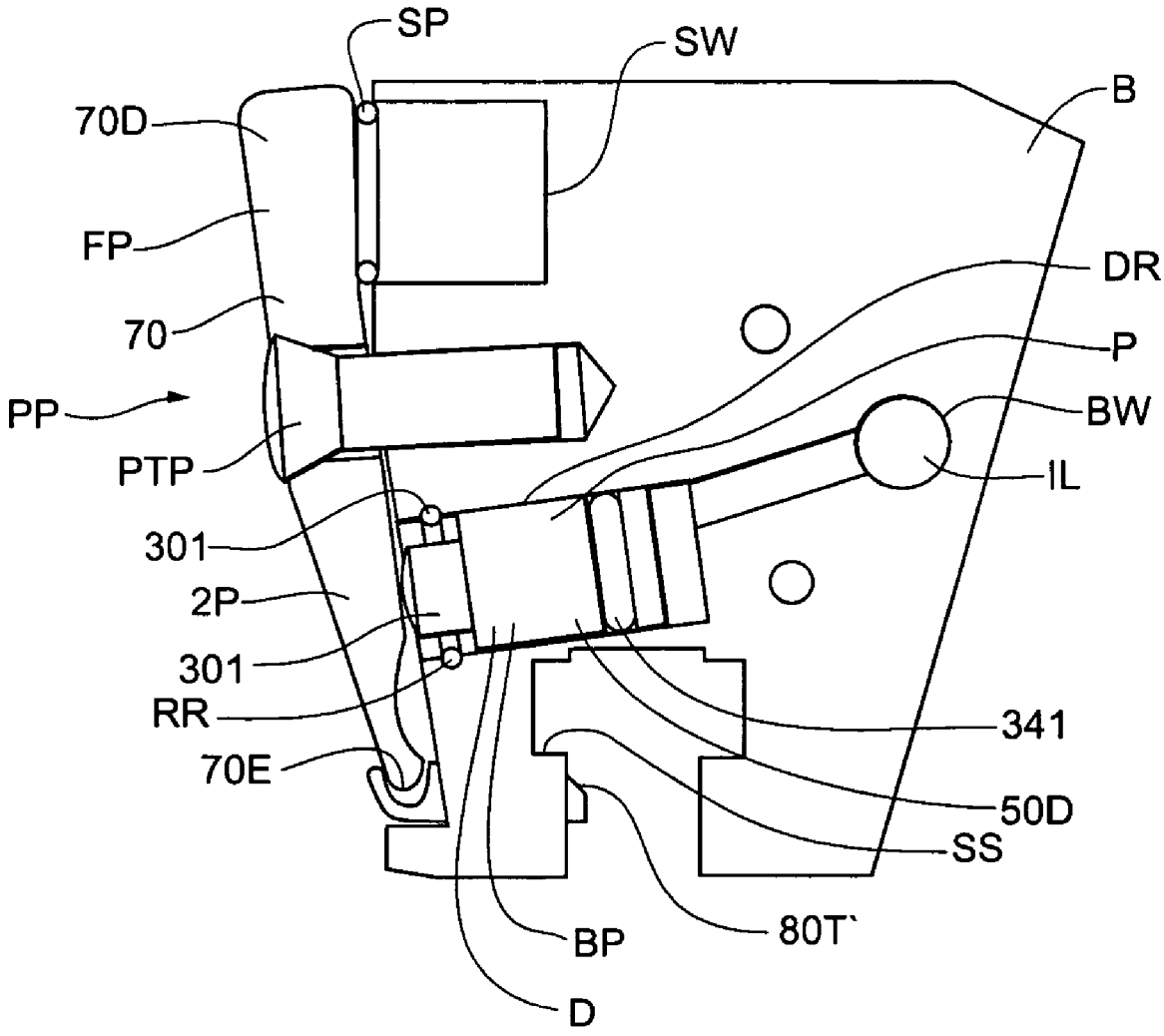
FIG. 10 is a schematic side view of a press brake tool holder in accordance with certain embodiments of the invention.
Figure 11:
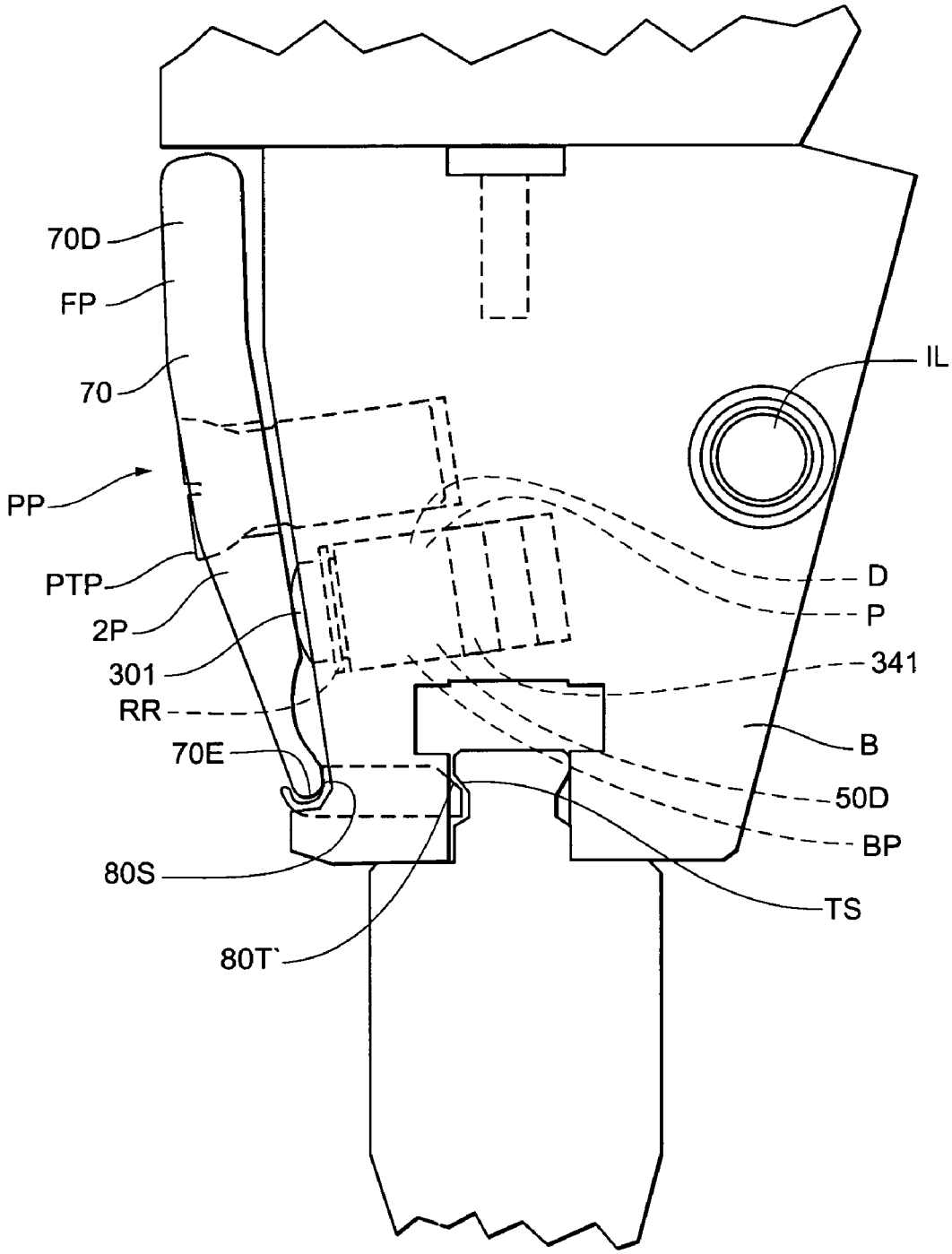
FIG. 11 is a broken-away schematic side view of a press brake tool holder, in combination with a press brake tool, in accordance with certain embodiments of the invention.
Figure 12A:
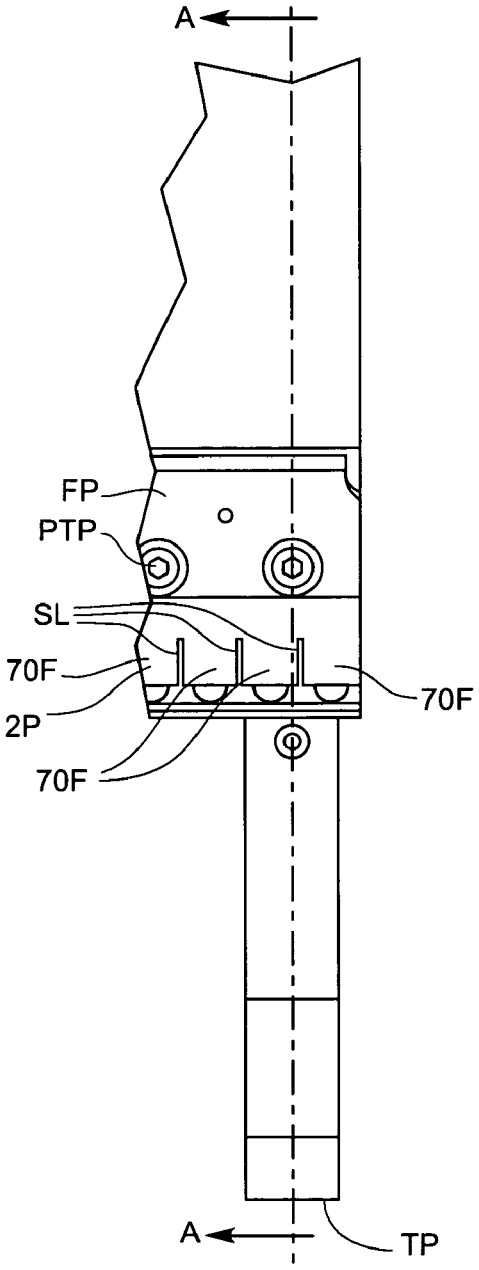
FIG. 12A is a partially broken-away schematic end view of a press brake tool holder, in combination with a press brake tool, in accordance with certain embodiments of the invention.
Figure 12B:
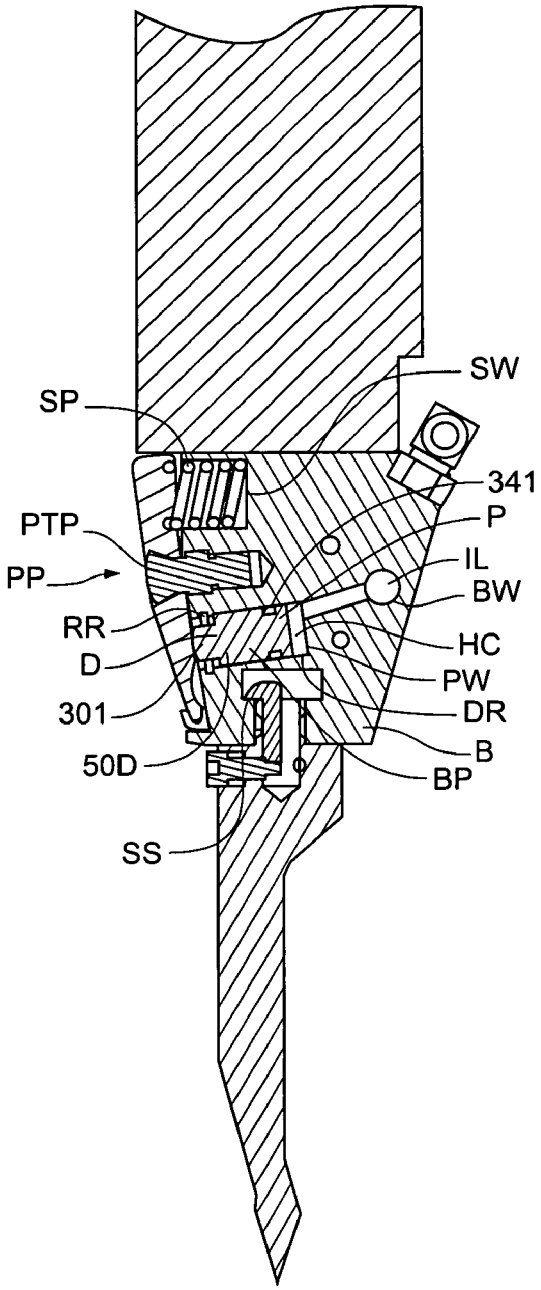
FIG. 12B is a partially broken-away cross-sectional side view of the combination shown in FIG. 12A taken along lines A-A.
Figure 13:
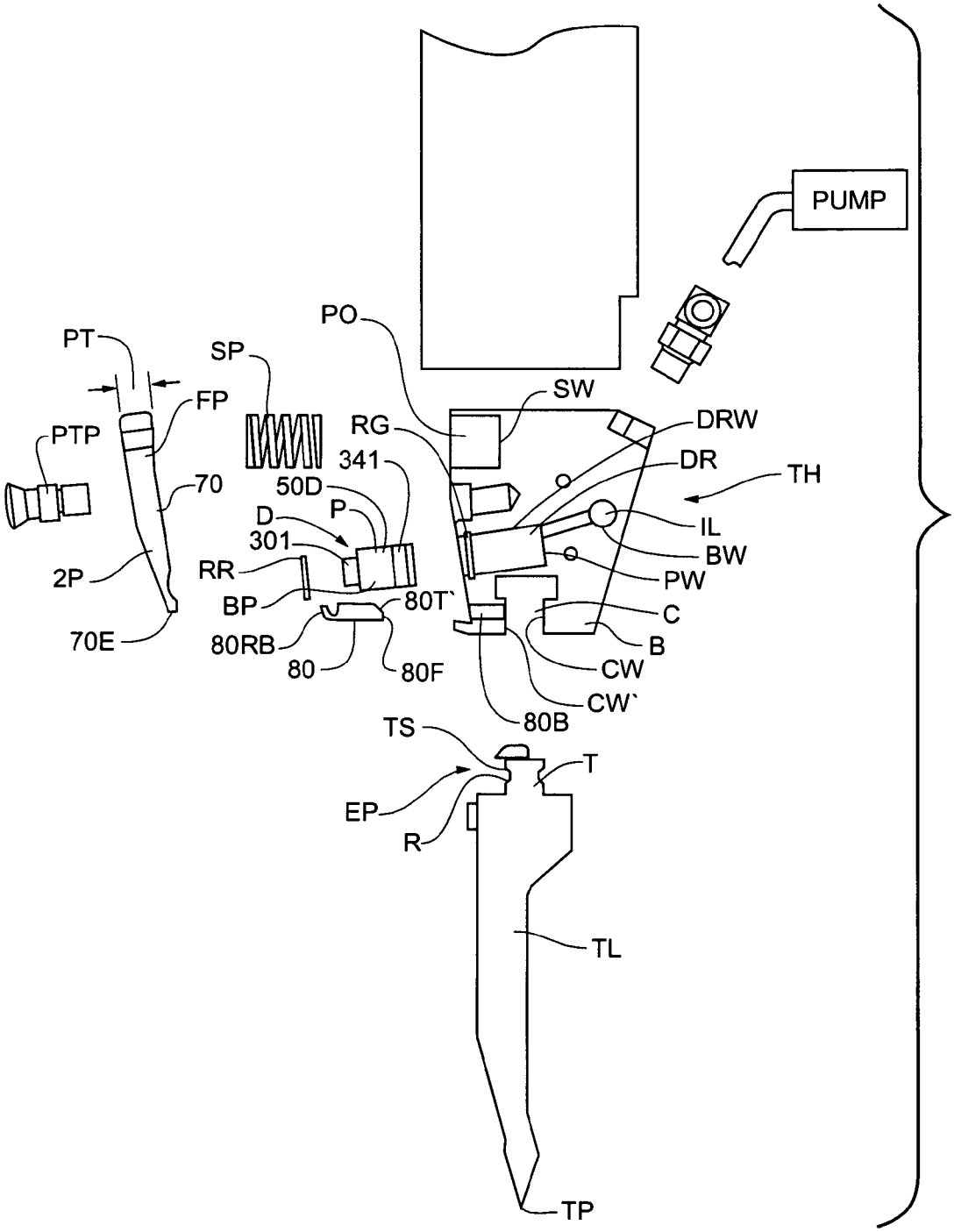
FIG. 13 is a partially broken-away exploded side view of the combination shown in FIGS. 12A and 12B.

In certain embodiments, the tool holder TH includes a plurality of seating members 80. Reference is made to FIG. 8.

Here, it can be appreciated that the illustrated embodiment involves a plurality of seating members 80 each mounted for lateral movement (i.e., along the x axis). Preferably, such seating members 80 are mounted slidably in respective bores 80B spaced-apart along a longitudinal length (i.e., along the z axis) of one CW' of the walls CW, CW of the tool holder. FIG. 8 is representative of a group of embodiments wherein one CW' of the walls CW, CW' carries a plurality of seating members 80, while the other wall CW is not provided with seating members. Each seating member 80 can optionally be mechanically linked to a single force-delivery finger 70F of a push plate 70 (described below). The features described in this paragraph are not required. Rather, they are strictly optional.

Referring again to FIG. 15, the rear end 80R of the illustrated seating member 80 has a rib (or "lip") 80RB that projects from a body portion 80BP (which optionally can be generally cylindrical) of the seating member. The illustrated rib 80RB defines a concave (e.g., generally C-shaped) surface 80S bounding at least part of the groove 80G. The shape of the groove/surface 80S can be adjusted so as to be generally U-shaped, V-shaped, etc. Preferably, the rib 80RB and the body portion 80BP are integral (i.e., of one-piece construction), although this is not required.

As previously discussed, the seating member 80 can optionally have a generally cylindrical configuration. In some embodiments of this nature, the seating member 80 has at least one cross section (taken along a plane lying in both the Y axis and the Z axis) that is at least generally circular or at least generally oval. Additionally or alternatively, the seating member can optionally have at least one cross section (taken along the noted plane) that is not circular, but rather is square, rectangular, triangular, otherwise polygonal, or irregularly shaped.

In some embodiments, the tool holder TH is provided with a push plate 70 that is moveable between first and second configurations. The tool holder TH, for example, can have a push plate 70 to which at least one seating member 80 is mechanically linked or otherwise operably coupled. The illustrated push plate 70 is mechanically linked to a plurality of seating members 80, although this is not strictly required. Due to the illustrated mechanical linkage, each seating member 80 moves from its closed position to its open position in response to movement of the push plate 70 from its first configuration to its second configuration. The groove 80G on the illustrated seating member 80 facilitates this mechanical linkage in that the groove receives the clamping end 70E of the push plate 70. In embodiments of this nature, the clamping end 70E of the push plate 70 preferably is retained in the groove 80G at all times during movement of the plate 70 between its first and second configurations. Thus, the illustrated seating member 80 moves to its closed position in response to the push plate 70 moving to its first configuration, and this seating member moves to its open position in response to the push plate moving to its second configuration. In some embodiments, the seating member is adapted to move toward, and/or away from, its closed position in response to the push plate bearing against a surface 80S on the trailing end region (at or adjacent the rear end 80R) of the seating member 80.

In embodiments involving a push plate 70, the plate when in its first configuration can optionally be under a constant force that provides resistance to the plate being moved away from (i.e., out of) this configuration. The force can optionally be a spring-generated force. In FIGS. 1-14, 16, and 17, at least one spring member SP is mounted between a distal (e.g., upper) end 70D of the push plate 70 and a wall SW of the tool holder. Preferably, a plurality of spring members SP (optionally at laterally spaced-apart locations) are so mounted between the/each push plate 70 and respective walls SW (or wall portions) of the tool holder. This is perhaps best appreciated with reference to FIG. 8. In some embodiments, the plate 70 is under a constant force that biases the plate toward its first configuration at all times/regardless of the configuration the push plate 70 is in. Reference is made to FIGS. 9-14, of which more will be said later.

When provided, the push plate 70 preferably is operably coupled with the seating member 80 such that when the plate is in its first configuration (one example of which is shown in FIGS. 1-3), the seating member is in its closed position (and the push plate optionally provides resistance against the seating member being moved out of its closed position and/or into its open position). For example, the clamping end 70E of the illustrated push plate 70 maintains (e.g., securely holds) the seating member 80 in its closed position when the push plate is in its first configuration. In some embodiments, when the push plate 70 is in its first configuration, the clamping end 70E of the push plate bears against a surface 80S on the trailing end region of the seating member 80, which (when a tool TL is operatively mounted in the channel C) is thereby clamped securely against the tang T of the tool TL.

In the illustrated embodiments, the trailing end region (which defines the rear end 80R) of the seating member 80 is located a distance from the channel C whether the seating member is in its open position or its closed position. This feature, however, is optional.

In certain embodiments, the tool holder TH can be operated so as to move the push plate 70 from its first configuration to its second configuration (one example of which is shown in FIGS. 4 and 5). In the illustrated embodiments, when the push plate 70 is in its second configuration, it does not prevent the seating member 80 from being moved to its open position. To the contrary, the illustrated seating member 80 moves to its open position in response to the push plate 70 moving to its second configuration. This can be accomplished, for example, by providing a suitable mechanical linkage between the push plate 70 and the seating member 80 (optionally between the clamping end of the push plate and the trailing end region of the seating member). In one particular group of embodiments, the seating member 80 moves axially (e.g., horizontally toward or away from the channel C) in response to the push plate 70 moving pivotally.

The seating member 80 can be mechanically linked to the push plate 70 by virtue of a male structure of the push plate being received in a female structure of the seating member. As noted above, the seating member can have a groove 80G. This groove 80G can serve as the female structure and can receive a male structure of the push plate. In the illustrations, the clamping end 70E of the push plate 70 serves as the male structure. Other mechanical linkages can be provided as well.

As has been described, some embodiments of the invention provide a pivotable push plate. Other embodiments provide a push plate that is mounted on the tool holder for linear movement. Still other embodiments do not involve a push plate at all. The features desired for a given application can be selected using the present disclosure as a guide.

One group of embodiments provides a tool holder having a tool-mount channel, a seating member, and a pivotable push plate. In these embodiments, the push plate is mounted on the tool holder so as to be moveable pivotally between first and second configurations. The seating member in such embodiments preferably is operably coupled with the push plate such that the seating member moves (e.g., axially and/or horizontally) to its closed position in response to the push plate pivoting to its first configuration. This can optionally be accomplished by virtue of an articulating joint between the seating member 80 and the push plate 70, as described below.

In some pivotable push plate embodiments, the seating member has a trailing end region that is located a distance from the tool-mount channel whether the seating member is in its open or closed position. Some embodiments of this nature provide an arrangement wherein when the push plate 70 pivots to its first configuration the plate 70 bears against a surface 80S of the seating member 80 so as to force the seating member to its closed position. In the illustrated embodiments, this surface 80S is defined by the trailing end region of the seating member. This is perhaps best appreciated with reference to FIGS. 1, 5, and 11.

Thus, one group of embodiments provides a tool holder with a push plate mounted on the tool holder so as to be moveable pivotally between a first configuration and a second configuration. As noted above, the tool holder preferably includes a seating member 80 mounted on a portion (optionally a stationary portion) of the tool holder so as to be moveable between an open position and a closed position. In pivotable push plate embodiments, the seating member preferably is operably coupled to the pivotable push plate such that the seating member moves to its closed position in response to the push plate pivoting to its first configuration. In some embodiments of this nature, the seating member is mechanically linked to the push plate by virtue of an articulating joint that facilitates simultaneous linear movement of the seating member and pivotal movement of the push plate.

In pivotable push plate embodiments, the plate has a desired pivot point PP. In some embodiments of this nature, the push plate when in its first configuration receives a force (e.g., is under a constant force) that provides resistance to the push plate pivoting out of its first configuration and/or biases the push plate toward its first configuration. This force can optionally be generated by at least one spring member SP located vertically further from the channel C than is the pivot point PP. One or more spring members SP of this nature can optionally be mounted between the push plate 70 and a wall SW (or respective walls) of the tool holder. In certain pivotable push plate embodiments, the tool holder is provided with a driver that is adapted for selective operation and that is operably coupled to the push plate such that the plate pivots to its second configuration (overcoming the noted force) in response to actuating the driver.

In some embodiments involving a tool holder and tool in combination, the tool holder TH is adapted for moving the tool TL in a pressing direction PD, the seating member 80 is adapted for delivering a force to the tool, and at least one of the leading end region 80FR of the seating member and the engagement portion EP of the tool's tang T comprises a taper surface 80T', TS, such that the noted force has a seating component that is at least generally parallel, and generally opposed, to the pressing direction PD. The pressing direction PD, for example, can be a generally or substantially vertical downward direction, and the seating force component can be a generally or substantially vertical upward force component. In such cases, the force preferably also has a generally or substantially horizontal clamping component.

In certain combination embodiments, the engagement portion EP of the tool's tang T has a recess R in which at least a portion of the leading end region 80FR of the seating member 80 is received when the seating member is in its closed position. This is perhaps best seen in FIG. 1.

In some combination embodiments, the channel C of the tool holder TH includes at least one safety recess (or "safety groove") SR, and the tang T of the tool TL includes a safety key K that is engaged with the safety recess so as to prevent the tang from falling out of the tool holder's channel. This can also be appreciated with reference to FIG. 1.

Preferably, the tool holder TH includes a driver D that serves as an actuator, and thus is adapted for being operated so as to open and/or close the tool holder. The illustrated embodiments provide a tool holder TH that assumes, or stays in, its closed configuration during any loss of power to the tool holder. Thus, when the illustrated driver D is in a non-energized state, the tool holder TH stays in its closed (e.g., clamped) configuration, thereby securely retaining any tools mounted on the tool holder. This provides an advantageous fail-safe feature.

Thus, the tool holder in the illustrated embodiments has a tool-mount channel, a seating member, and a driver D. The driver preferably is adapted for selective operation, such that by actuating the driver at a desired time the seating member in response moves to its open position. This movement of the seating member can optionally involve at least part of the seating member moving away from the tool-mount channel C. Each driver D shown in FIGS. 1-14 and 16-19 is a hydraulic driver adapted for being actuated by delivering hydraulic fluid to the driver (e.g., by delivering an increasing pressure of hydraulic fluid into a hydraulic chamber HC of the driver), in response to which the seating member moves to its open position.

Whether or not the driver is hydraulic, it preferably is operably coupled to the push plate such that the plate moves to its second configuration in response to actuating the driver. In some embodiments of this nature, the seating member is mechanically linked to the push plate such that the seating member is forced by the push plate to move to its open position when the push plate moves to its second configuration. As noted above, the push plate can be mechanically linked to the seating member by an articulating joint, which optionally facilitates linear movement of the seating member and simultaneous pivotal movement of the push plate.

The illustrated driver D is hydraulic. However, the driver D can alternatively be mechanical, pneumatic, and/or thermally responsive. In certain embodiments, the driver D is a solenoid selected from the group consisting of a hydraulic solenoid, a pneumatic solenoid, and an electrical solenoid.

In one alternate embodiment, the driver D comprises a thermally-responsive actuator of the type described in U.S. patent application Ser. No. 10/876,886, entitled "Thermally-Actuated Press Brake Tool Holder Technology", the entire contents of which are incorporated herein by reference. Each hydraulic subassembly shown in the drawings, for example, can optionally be replaced with a reservoir/polymer/heating element subassembly. A subassembly of this nature, for example, can involve a thermally-responsive polymer disposed in a reservoir of the tool holder. Preferably, a piston-like body is in fluid communication with the polymer, and the polymer can be heated (e.g., by operating a heating element in, or adjacent to, the reservoir) so as to cause the polymer in the reservoir to expand and bear forcibly against the piston-like body, thus moving the piston-like body in such a way that the tool holder is actuated (e.g., opened).

In embodiments where the tool holder has a hydraulic driver, a hydraulic subassembly can be built directly into the body of the tool holder. The body (e.g., a single block) of the tool holder, for example, can define one or more internal channels and/or recesses in which internal components of the hydraulic subassembly are disposed. These internal components can optionally include hydraulic fluid, O-rings, a hydraulic cylinder, etc. Preferably, the hydraulic subassembly includes a cylinder or another moveable body 50D, 150D that acts like a piston P. In the illustrated embodiments, at least part of the body 50D, 150D is moveable in response to delivering hydraulic fluid into the hydraulic chamber HC.

The tool holder can optionally include an internal hydraulic line IL. In some embodiments, the internal hydraulic line IL is provided in the form of a bore at least a length of which extends through the body (e.g., a block) B of the tool holder. In one subgroup of embodiments, the block B also defines at least part of one of the confronting walls CW, CW' of the tool holder TH. Hydraulic fluid will generally (e.g., during use) be disposed within the hydraulic line IL, the block B will commonly be a piece of metal, and the hydraulic fluid can advantageously be in direct contact with an inner surface BW of the hydraulic line length that is defined by the block (e.g., such that this inner surface is defined by the metal of the block).

Optionally, the tool holder includes an internal hydraulic line IL that is adapted for use at pressures in excess of about 1,000 psi, such as between about 1,000 psi and about 5,000 psi, perhaps optimally between about 3,500 psi and about 5,000 psi. In certain method embodiments, the method comprises delivering hydraulic fluid (e.g., oil), optionally pressurized at 1,000 psi or more, through the internal hydraulic line IL and into the hydraulic chamber HC, with the result that the tool holder is actuated (i.e., moved into either an open or closed configuration).

As noted above, certain embodiments provide a tool holder TH wherein the channel C is bounded by two confronting walls both defined (at least in part) by a single (e.g., one-piece) block of the tool holder. In some embodiments of this nature, the block defines one or more internal channels and/or recesses. For example, the block can have (e.g., can bound) an internal hydraulic chamber HC and/or one or more internal hydraulic lines IL (optionally bounded by a wall BW of the block). In these embodiments, the driver D preferably is adapted for being operated by delivering hydraulic fluid to the hydraulic chamber HC in response to which at least one seating member 80 mounted on a portion (optionally a stationary portion and/or a portion defined by the block B) of the tool holder moves (e.g., slides horizontally and/or axially) relative to such portion of the tool holder. In some embodiments of this nature, the seating member comprises a rigid body mounted slidably in a bore extending through such portion of the tool holder. Embodiments involving a hydraulic subassembly built into the body of the tool holder provide a number of advantages, including compactness, functionality in making narrow bends in workpieces, and flexibility in terms of hydraulic pressures.

In alternate embodiments, the tool holder TH is provided with a hydraulic subassembly that is mounted on a side of the tool holder. In these embodiments, for example, a hydraulic manifold can be mounted on a desired side of the tool holder.

In one group of embodiments, the tool holder is provided with a hydraulic driver and a pivotable push plate. Here, the driver is adapted for being actuated by delivering hydraulic fluid to the driver, in response to which the push plate preferably pivots to its second configuration, which in turn preferably causes the seating member to move to its open position. Preferably, this movement of the seating member 80 involves at least part of the seating member moving away from the tool-mount channel C and/or moving relative to the tool holder portion on which the seating member is mounted.

Some preferred embodiments provide a hydraulic driver that is devoid of (i.e., does not include) any flexible-wall hydraulic or pneumatic lines (e.g., bellows or hoses). In some embodiments of this nature, the driver D includes an internal hydraulic chamber HC and/or internal hydraulic lines IL having internal walls BW defined by the tool holder's body B (which preferably is a rigid block, e.g., of metal). These embodiments can be provided to facilitate higher fluid pressure than is conventional for flexible-wall bellows, hoses, etc.

With reference to FIGS. 1-8, the illustrated driver D is mounted in a recess DR defined by the body B of the tool holder TH. The illustrated driver D is hydraulic and includes a hydraulic chamber HC. In this embodiment, an internal hydraulic line or channel IL extends through the body B of the tool holder and opens into the hydraulic chamber HC. A hydraulic tee fitting can optionally be provided to connect the internal hydraulic line or channel IL to an external hydraulic line, which preferably leads to a hydraulic pump.

In certain embodiments, a moveable body 50D, 150D that is part of, or cooperates with, the driver D is moveable in response to delivering hydraulic fluid into the hydraulic chamber HC. FIGS. 1-8 exemplify embodiments wherein the driver D comprises a pull piston subassembly. Here, the moveable body 50D comprises a piston P and a piston nose member R. The illustrated piston P has a large-dimension base portion BP, a narrow neck portion NP, and a middle portion CP. As is perhaps best seen in FIG. 8, the illustrated base portion BP has a larger diameter than the middle portion CP, which has a larger diameter than the neck portion NP. The illustrated neck portion NP is threaded (e.g., exteriorly threaded) and is joined to the piston nose member R by advancing the threaded neck portion into a correspondingly threaded (e.g., interiorly threaded) cavity CA in the piston nose member. The recess DR has a first large-dimension section, a narrow middle section, and a second large-dimension section, the narrow middle section connecting the two large-dimension sections. The base portion BP of the piston P is mounted in the first large-dimension section of the recess DR. The middle portion CP of the piston P extends through (and preferably fits snuggly and slidably in) the narrow section of the recess DR. An O-ring 141 or the like can advantageously be provided on the middle portion CP of the piston P so as to create a fluid-tight dynamic seal between the middle portion of the piston and the wall bounding the narrow section of the recess DR. Likewise, an O-ring 241 or the like can be provided on the base portion BP of the piston P so as to create a fluid-tight dynamic seal between the base portion of the piston and the wall bounding the first large-dimension section of the recess DR. In FIGS. 4 and 5, the illustrated hydraulic chamber HC is formed between the base portion BP of the piston P and a wall PW of the tool holder's body B. Thus, when enough pressurized fluid is delivered into the hydraulic chamber HC, this fluid bears forcibly against the base BP of the piston P, causing it to slide (e.g., axially), e.g., in the leftward direction as shown in FIGS. 1-5. When the piston P slides in this direction, it pulls the piston nose member R along with it, while in the process overcoming the force generated by the illustrated spring SP. As the piston nose member R moves in this manner, the push plate 70 is allowed to pivot (counterclockwise as shown in FIGS. 1-5). A small spring PS mounted between the push plate 70 and a wall of the tool holder biases the push plate in such a way that the plate pivots to its second configuration when the nose member R moves to its retracted position. The illustrated pull piston subassembly normally maintains the tool holder in its closed position by virtue of the spring SP bearing against the piston nose member R. This spring SP is compressed between a wall SW of the tool holder and a large-dimension head portion 201 of the piston nose member R. In the illustrated arrangement, this compression spring SP is nested around a neck portion 211 of the piston nose member R. Here, the neck portion 211 has a smaller diameter than the head portion 201. The spring SP keeps the assembled piston/nose member in its extended position (shown in FIGS. 1-3) unless enough pressurized fluid is delivered into the hydraulic chamber HC. The two-piece piston/nose member assembly could alternatively be replaced with a single (i.e., integral) body having a similar overall configuration. However, the illustrated two-piece configuration is advantageous in that it is particularly easy to assembly on the tool holder.

Thus, certain embodiments provide a tool holder TH that assumes, or stays in, a closed configuration during any loss of power. In embodiments of this nature, the default configuration of the tool holder TH is its closed configuration, in which configuration any tools mounted on the tool holder are securely retained. This fail-safe functionality can be provided in different ways. In some cases, this is accomplished by providing the tool holder with a mechanism that constantly biases the tool holder toward its closed configuration. FIGS. 9-14 illustrated one such embodiment wherein the illustrated push plate is under a constant spring-generated force that biases the push plate toward its first configuration. Here, the driver D comprises a moveable body 50D that is provided in the form of a piston P. Preferably, at least part of the piston P is mounted in a recess DR formed in the body B of the tool holder TH, as is perhaps best appreciated with reference to FIG. 13. The piston P illustrated in FIGS. 9-14 has a large-dimension base portion BP and a narrow nose portion 301. The nose portion 301 of the illustrated piston P has a smaller diameter than the base portion BP. As is perhaps best seen in FIG. 12B, when the tool holder is assembled, a hydraulic chamber HC is formed between the base portion BP of the piston P and a wall PW of the tool holder. The piston P here is secured in the recess DR using a retaining ring or clip RR mounted in a retaining groove RG (shown in FIG. 13) near the outlet of the recess DR. An O-ring 341 or the like is preferably provided on the base portion BP of the piston P so as to create a fluid-tight dynamic seal between the base portion of the piston and the wall DRW (shown in FIG. 13) that bounds the recess DR. When enough pressurized fluid is delivered to the hydraulic chamber HC, the fluid bears forcibly against the base portion BP of the piston P, causing it to slide (e.g., axially), e.g., in the leftward direction in FIGS. 9-11, 12B, and 13. When the piston P slides in this direction, it causes the push plate 70 to pivot (clockwise as shown in FIGS. 9-11, 12B, and 13) while overcoming the force generated by the illustrated spring SP. This arrangement normally maintains the tool holder in its closed position by virtue of the illustrated spring SP, which applies to the push plate 70 a constant force biasing the plate 70 toward its first configuration. Thus, the spring SP keeps the push plate 70 in its first configuration, which in turn keeps the piston P in its retracted position (shown in FIGS. 9-11 and 12B), unless enough pressurized fluid is delivered into the hydraulic chamber HC.

The recess DR optionally extends along an axis that is at least generally perpendicular to the tool holder's pressing axis PA. Preferably, the moveable body 50D is mounted in the recess DR so as to be slidable along the axis of the recess DR, e.g., between a retracted position and an extended position. When the moveable body 50D is in its extended position, it desirably bears (e.g., forcibly) against the push plate 70. The recess DR preferably has an outlet that opens through a wall (e.g., defined by the body B) of the tool holder. Preferably, this outlet is at least somewhat (or at least substantially entirely) covered by the push plate 70.

As noted above, in certain embodiments, the tool holder TH includes a push plate 70 mounted on the tool holder so as to be moveable between a first configuration and a second configuration. Preferably, the first configuration is a closed configuration (as shown in FIGS. 1-3, 7, 9-11, 12B, 14, 16, 17, and 18), while the second configuration is an open configuration (as shown in FIGS. 4, 5, and 19). The push plate 70 desirably can be moved from its first configuration to its second configuration by operating a driver D of the tool holder TH. When a driver D is provided, it preferably is adapted for moving the push plate 70 by transmitting force (either directly or via one or more other bodies) to the push plate. In some embodiments, the tool holder is opened by operating the driver so as to pivot the push plate 70, such that the clamping end 70E of the push plate is moved away from the body B of the tool holder. Preferably, this allows (and optionally causes) the rear end 80R of the seating member 80 to move away from the tool-mount channel C (and in combination embodiments, away from the tang of a tool mounted in the channel).

Figure 18:
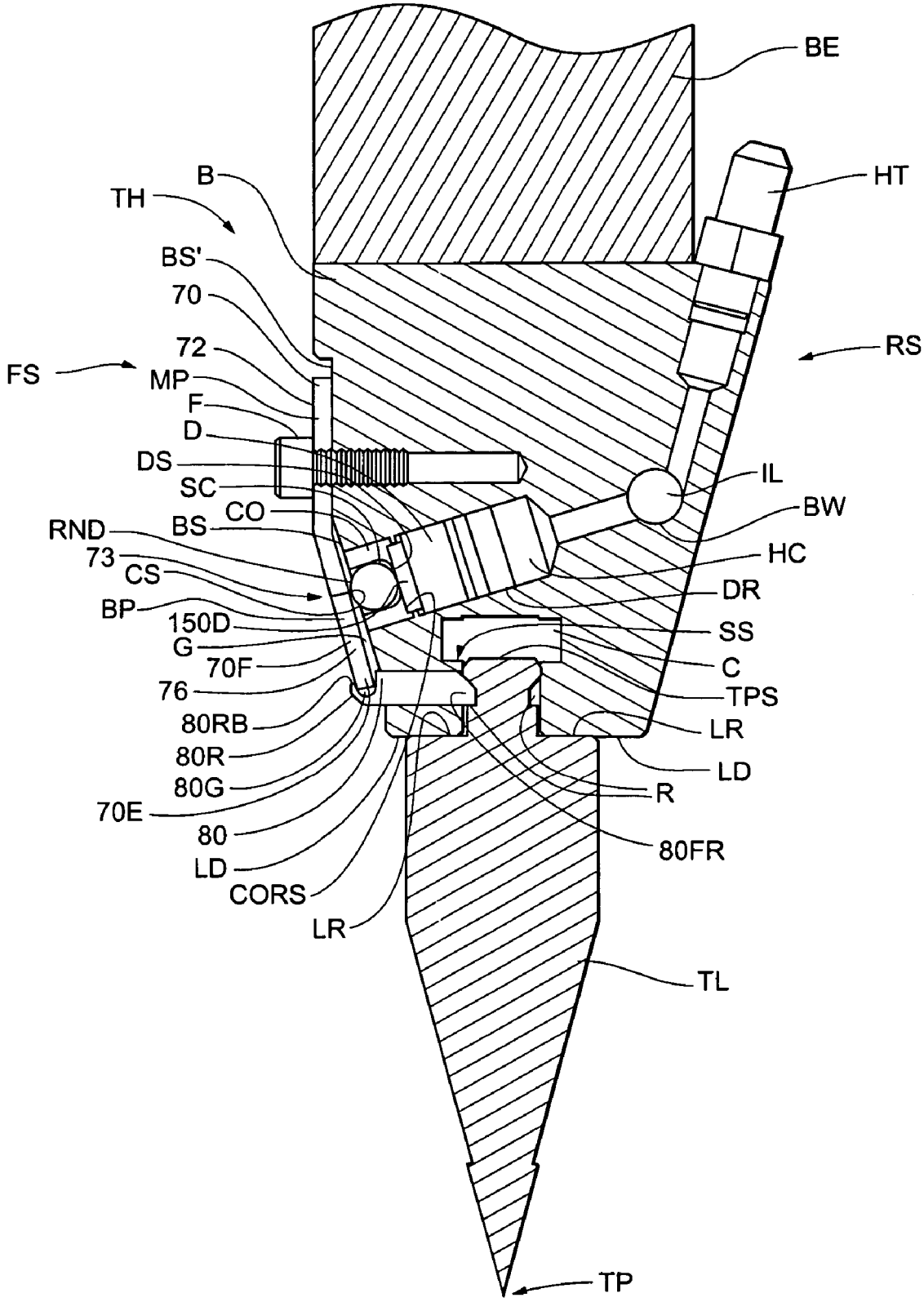
FIG. 18 is a partially broken-away cross-sectional side view of a press brake tool holder, in combination with a press brake tool, in accordance with certain embodiments of the invention.
Figure 19:
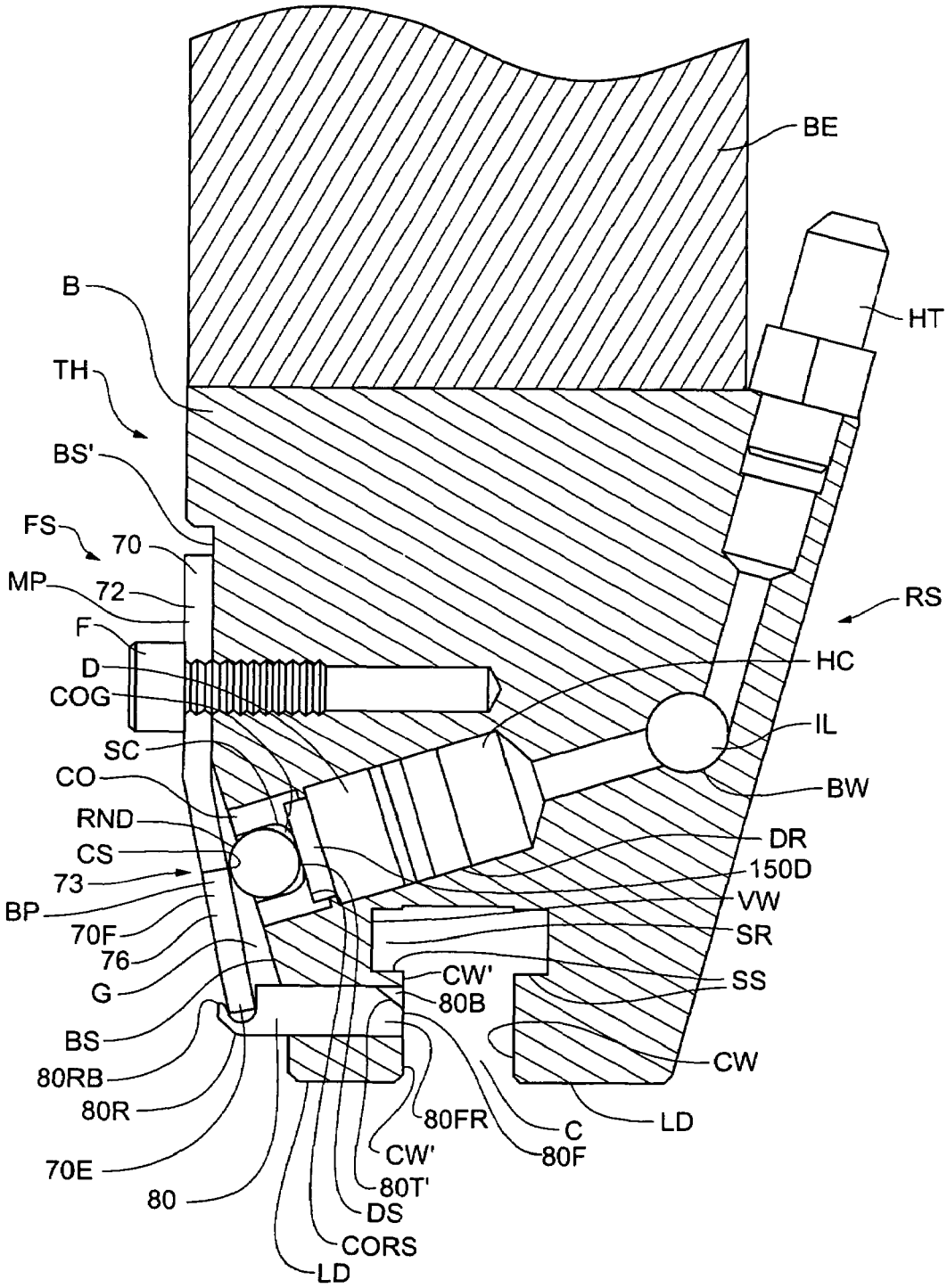
FIG. 19 is a partially broken-away cross-sectional side view of a press brake tool holder in accordance with certain embodiments of the invention.

FIGS. 18 and 19 depict exemplary embodiments involving a push plate 70 that is moveable from it first configuration to its second configuration by a bending of the plate 70. Embodiments of this nature are detailed in U.S. patent application Ser. No. 11/053,134 (entitled "Push Plate Tool Holder for Press Brakes," filed Feb. 8, 2005), the entire disclosure of which is incorporated herein by reference. Here, the tool holder TH preferably includes a push plate 70 to which a driver D is operably coupled. The push plate 70 is mounted on the tool holder TH so as to be moveable between a first configuration and a second configuration. Preferably, the first configuration is a closed configuration, while the second configuration is an open configuration. The illustrated driver D is adapted for being operated so as to move the push plate 70 from its first configuration to its second configuration. Preferably, the driver D moves the push plate 70 in this manner by transmitting force (either directly or via one or more other bodies CO, R) to the push plate 70.

With continued reference to FIGS. 18 and 19, the illustrated push plate 70 is mounted on the tool holder TH so as to be moveable from its first configuration to its second configuration by a deformation (e.g., a bending) of the push plate. In some preferred embodiments of this nature, the push plate 70 has an anchored side 72 and a free side 76, the anchored side is rigidly secured to the tool holder TH, and the push plate is mounted on the tool holder so as to be moveable from its first configuration to its second configuration by a bending of the push plate in which the free side of the push plate moves generally away from the tool holder (and/or generally away from the tool-mount channel).

In some embodiments of the nature exemplified in FIGS. 18 and 19, the push plate 70 comprises (e.g., is) a resilient plate (e.g., comprising or consisting essentially of metal). The push plate 70, for example, can be formed of steel. In some cases, the push plate is a resilient metal plate comprising a sheet steel. In one particular embodiment, the push plate comprises or consists essentially of a spring steel. Preferably, the plate shown in FIGS. 18 and 19 can optionally have a thickness of less than about ½ inch, preferably less than about ¼ inch, such as about 0.060-0.156 inch. In one particular embodiment, the thickness is about 0.120 inch. In certain embodiments, the push plate has a thickness that is substantially constant over substantially all (or all) areas of the plate. However, this is by no means required.

The plate 70 illustrated in FIGS. 18 and 19 comprises two portions BP, MP that are generally or substantially planar. The base portion BP of the illustrated plate 70 lies in a different plane than the mount portion MP. Preferably, these two portions MP, BP lie in respective planes that are offset by a desired angle, which is preferably acute. This angle, for example, can optionally be at least about 2 degrees, perhaps preferably between about 5 degrees and about 40 degrees, and perhaps optimally between about 10 degrees and about 30 degrees, such as about 20 degrees.

Thus, FIGS. 18 and 19 are representative of embodiments wherein the push plate 70 has an anchored side 72 and a free side 76. Preferably, the anchored side 72 is rigidly secured to a body (e.g., a block) B of the tool holder TH. In FIGS. 18 and 19, the plate 70 is removably secured to the body B of the tool holder. In other embodiments, the push plate 70 is permanently joined, or integral, to the body B of the tool holder TH.

In FIGS. 18 and 19, the free side 76 of the push plate 70 is bent away from the body B of the tool holder TH when the push plate is in its second configuration. It can be appreciated that this type of push plate 70 is in a loaded, deflected state when in its second configuration. In more detail, when such a push plate 70 is in its second configuration, the free end 70E of the plate 70 is spaced apart from the body B of the tool holder TH. In some cases, the free end 70E of the push plate 70 is also spaced apart from the body B of the tool holder TH when the plate 70 is in its first configuration, but not to the same extent as when the plate 70 is in it second configuration. In such cases, there is a gap G (whether the push plate is in its first configuration or its second configuration) between the free side 76 of the push plate 70 and the body B of the tool holder TH, such that this gap G has a greater width when the push plate is in its second configuration than when the push plate is in its first configuration. This is not strictly required. For example, the tool holder can alternatively be designed and set-up such that when the plate 70 is in its first configuration it 70 is directly against the body B of the tool holder.

If so desired, the seating member 80 (in any embodiment) can be resiliently biased (e.g., by one or more springs) away from the channel C (e.g., in embodiments where the push plate and seating member are not mechanically linked) so that the seating member automatically moves away from the channel C when the push plate 70 moves into its second configuration. Alternatively, the seating member 80 can simply be mounted for free sliding in the bore 80B. More preferably, the push plate 70 and seating member 80 are mechanically linked, as noted above, such that when the push plate moves from its first configuration to its second configuration, the seating member is forced (e.g., pushed and/or pulled) by the push plate to move from its closed position to its open position. The illustrated mechanical linkage has been described. Other types of mechanical linkage can also be used.

The invention provides one group of embodiments wherein the tool holder includes a hydraulic driver that is operably connected to a hydraulic pump. In some of these embodiments, the pump is adapted for generating a discharge pressure of greater than 1,000 psi, preferably between about 2,000 psi and about 5,000 psi, and perhaps more preferably between about 3,500 psi and about 5,000 psi. Suitable hydraulic pumps are commercially available from a number of suppliers, such as Enerpac, which maintains a distributorship in Milwaukee, Wis., U.S.A. Some methods of the invention involve operating the tool holder by actuating a hydraulic pump so as to generate a discharge pressure of greater than 1,000 psi, preferably between about 2,000 psi and about 5,000 psi, and perhaps more preferably between about 3,500 psi and about 5,000 psi. In embodiments involving an interior hydraulic line IL, this results in the delivery of hydraulic fluid at such pressure through the hydraulic line. For example, certain methods provide a tool holder including a piston (optionally defined at least in part by a cylinder) and a hydraulic chamber, and the methods involve operating the hydraulic pump at a discharge pressure within one or more of the noted-pressure ranges (e.g., so as to deliver such pressurized hydraulic fluid into the hydraulic chamber), thereby forcing the piston to move in such a way that the push plate is caused to move (i.e., responds by moving) to its second configuration.

As noted above, the push plate 70 can optionally be mounted pivotally on the tool holder. In some embodiments, for example, the push plate 70 is mounted pivotally on the tool holder such that the plate 70 is prevented from moving substantially in a direction (e.g., in a vertical direction) parallel to the tool holder's pressing axis PA. In some embodiments, one or more pivot pins PTP (defining the pivot point PP of the push plate 70) are used to pivotally anchor the push plate 70 to the tool holder TH. For example, the push plate 70 can optionally be mounted on the tool holder TH such that the plate 70 is prevented from moving substantially in any manner other than by pivoting relative to the body B of the tool holder (e.g., such that the clamping end 70E of the push plate moves generally toward or away from the tool-mount channel when the plate pivots).

In certain embodiments, the push plate 70 when mounted on the tool holder TH is carried alongside the body B of the tool holder. This body B, for example, can be a single block of metal (e.g., steel). Optionally, such a block can define at least part of each wall CW, CW', at least part of each load-delivering surface LD, an internal hydraulic chamber/reservoir HC, and/or an internal hydraulic line IL.

In preferred embodiments, the push plate (or "clamp plate") 70 has a maximum thickness PT of between about 0.06 inch and about 0.75 inch. These dimensions, however, are by no means required.

Figure 14:
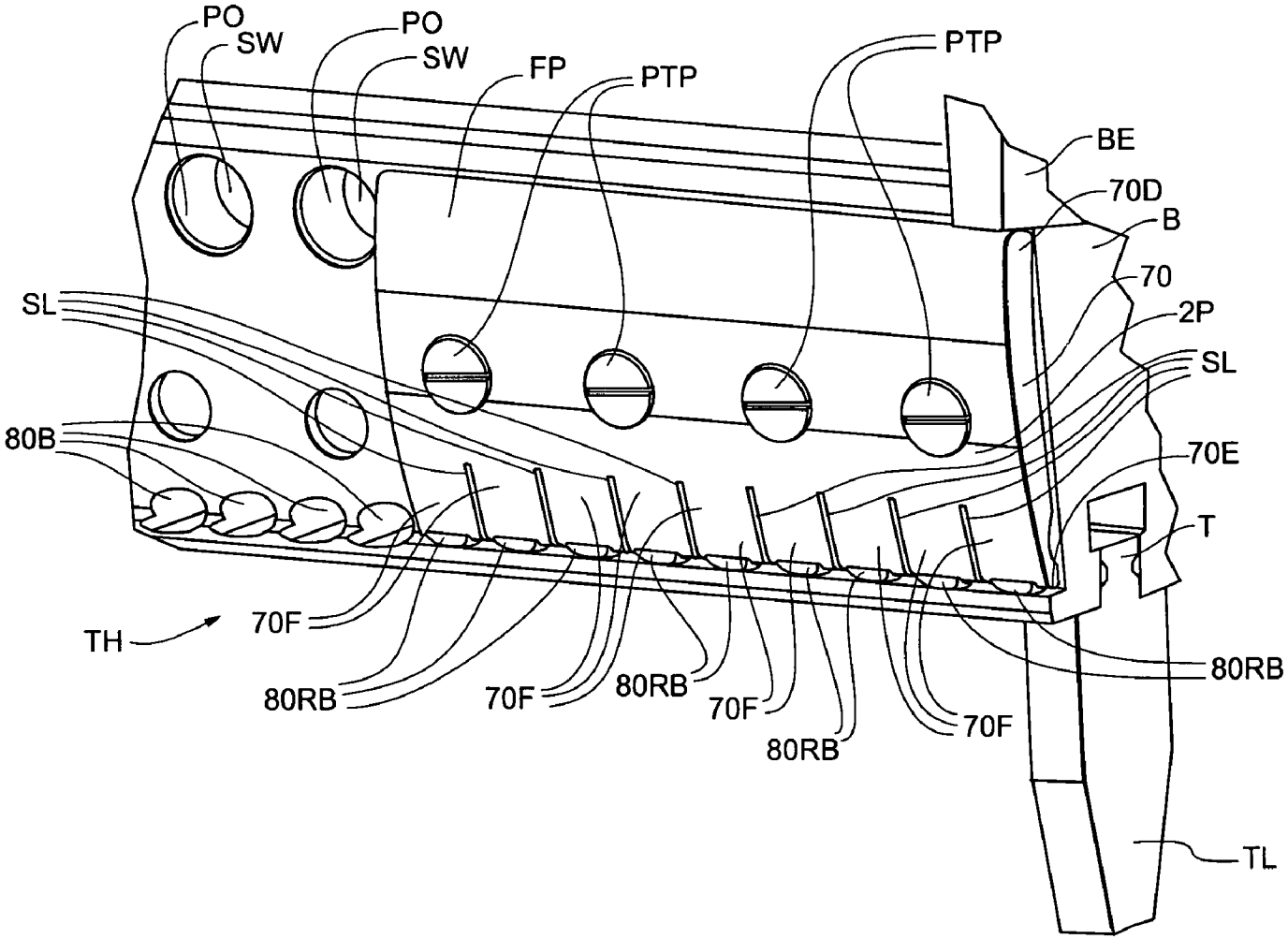
FIG. 14 is a broken-away perspective view of a press brake tool holder, in combination with a press brake tool, in accordance with certain embodiments of the invention.

In FIG. 14, the illustrated push plate 70 comprises a plurality of force-delivery fingers 70F. The fingers 70F are separated by slits SL, e.g., such that the two fingers of each adjacent pair are separated by a slit SL. Preferably, the push plate 70 includes a plurality of fingers 70F and a plurality of slits SL, each slit extending entirely through a thickness of the push plate and being bounded by two of the fingers. In the illustrated embodiments, the slits SL all have the same, or substantially the same, length. This, however, is not required. Moreover, the push plate need not have any slits or fingers.

In the illustrated embodiments, the push plate has a first portion FP and a second portion 2P. The first FP and second 2P portions of the illustrated plate 70 are located on opposite sides of the plate's pivot point PP. In the illustrated embodiments, the first portion FP of the push plate 70 and the second portion 2P of the push plate are defined by one integral body. That is, the illustrated push plate 70 is of one-piece construction. While this has advantages, it is not required.

In certain embodiments, the tool holder TH is provided with the following features: (1) a push plate 70 having a plurality of force-delivery fingers 70F and a plurality of slits SL, each slit extending entirely through the thickness of the push plate and being bounded by two of the force-delivery fingers; and (2) when the push plate is in its first configuration one (e.g., only one) of the fingers 70F bears forcibly against the seating member 80. In some embodiments of this nature, the tool holder TH is also provided with the following features: (3) the push plate 70 has a first portion FP and a second portion 2P, the second portion defines the fingers 70F, and the slits SL do not extend into the first portion. In the illustrated embodiments, a plurality of fingers 70 bear forcibly against respective seating members 80 (such that each finger is mechanically linked to (and is in direct contact with) a single seating member.

In some embodiments, the tool holder is provided with a push plate that is removably secured to the body of the tool holder. In these embodiments, the push plate and tool holder's body are two different pieces. The plate 70, for example, can optionally be mounted on the body of the tool holder by a plurality of removable fasteners (e.g., bolts). In other embodiments, the push plate is permanently joined, or integral, to the body of the tool holder.

When the illustrated push plate 70 is in its second configuration, the clamping end (or "first end") 70E of the push plate is spaced further from the tool holder's body B (and further from the channel C) than it is when the plate 70 is in its first configuration. Further, the clamping end 70E of the illustrated push plate 70 bears forcibly against the seating member 80 when the push plate is in its first configuration. These features, however, are not strictly required.

The invention provides various methods involving the tool holder TH. In one group of embodiments, there is provided a method of operating a press brake. Here, the method comprises: (a) providing a press brake tool holder TH and a press brake tool TL in a combination wherein the tool holder TH has a channel C in which a tang T of the tool TL is received and securely clamped. The tool holder TH in the present method preferably comprises: (i) a driver D; (ii) a push plate 70 to which the driver is operably coupled, the push plate being mounted on the tool holder so as to be moveable between a first configuration and a second configuration, the push plate being in its first configuration, wherein the driver is adapted for being operated so as to move the push plate to its second configuration, and (iii) a seating member 80 mounted on the tool holder TH so as to be moveable between an open position and a closed position, the seating member being in its closed position such that a leading end region 80FR of the seating member bears against the tang T of the tool TL (e.g., so as to deliver a force to the tool), the seating member being operably coupled with the push plate such that the plate bears upon the seating member and provides resistance against the seating member being moved to its open position. The present method comprises operating the driver D (optionally by carrying out a hydraulic fluid delivery step, such as one of those described above) so as to move the push plate 70 (optionally by pivoting the plate) from its first configuration to its second configuration, thereby eliminating or reducing the force on the tool (e.g., as a result of the seating member(s) moving to the open position in response to the push plate moving to its second configuration).

In certain embodiments of the present group, the invention provides a method of closing the tool holder TH. Here, the push plate 70 is moved from its second configuration to its first configuration. This causes the push plate 70 to bear forcibly against the seating member 80, which in turn causes the seating member to bear against the tool TL so as to deliver a force to the tool. Optionally, the clamping end 70E of the push plate 70 bears against a surface 80S on the trailing end region of the seating member 80, causing the leading end region 80FR of the seating member to bear against an engagement portion EP of the tool's tang T. Preferably, this results in a seating force being delivered to the tool so as to move the tool until the load-bearing surfaces LD, LR of the tool and tool holder come into contact.

As noted above, the force delivered to the tool TL (e.g., during closing of the tool holder on the tool's tang) preferably has a seating component and a clamping component. The seating component preferably moves the tool TL so as to bring the load-receiving surface(s) LR of the tool TL into direct contact with the load-delivering surface(s) LD of the tool holder TH. The clamping component preferably forces the tang T of the tool against a wall CW bounding the tool-mount channel C. Preferably, the seating component is at least generally or substantially parallel to the pressing axis PA, while the clamping component is at least generally or substantially perpendicular to the pressing axis PA. In certain preferred embodiments, the seating component is vertical (and in some cases, is an upward vertical force component), while the clamping component is horizontal.

As noted above, certain embodiments provide a method of operating a tool holder having a hydraulic driver. In some embodiments of this nature, the hydraulic driver is adapted for being operated by delivering hydraulic fluid into a hydraulic chamber of the driver, in response to which at least one seating member (and optionally a plurality of seating members all mounted on the same wall CW') 80 moves relative to a stationary portion of the tool holder on which the seating member is mounted. Here, the method optionally comprises delivering such hydraulic fluid into the hydraulic chamber at a pressure of at least about 1,000 psi, between about 2,000 psi and about 5,000 psi, and/or between about 3,500 psi and about 5,000 psi.

As noted above, certain embodiments of the invention provide, in combination, a tool holder and a press brake tool. Here, the tang T of the tool TL is received in the channel C of the tool holder TH. In some embodiments of this nature, the tool holder includes: (a) a driver D; (b) a push plate 70, and; (c) a seating member 80. Preferably, the driver D is operably coupled with the push plate 70, as has been described. The push plate 70 can optionally be mounted on the tool holder TH so as to be moveable between a first configuration and a second configuration, as has also been described. In one group of combination embodiments, the push plate 70 is in its first configuration and the driver D is adapted for being operated so as to cause the push plate to move to its second configuration. In the present group of combination embodiments, the seating member 80 is in its closed position and the leading end region 80FR of the seating member 80 bears against the tang T of the tool TL (e.g., against an engagement portion of the tool's tang). Here, the seating member 80 is operably coupled with the push plate 70 such that the plate 70 applies resistance against the seating member being moved to its open position.

FIGS. 16 and 17 depict exemplary embodiments wherein there is provided a tool holder having a tool-seating mechanism in combination with a click-in/slide-out press brake tool. Here, once the tang T of the illustrated tool TL has been positioned in the tool holder's channel C (such that an engagement portion 580 of the tool's safety key K is received in a safety recess SR of the tool holder), a press brake worker is not able to operate any externally-accessible actuator on the tool (since the tool in the present embodiments has no such actuator) so as to cause the safety key to retract and move out of engagement with the safety recess. Further, the tool holder in these embodiments has no externally-accessible actuator that can be operated to retract the safety key of the mounted (e.g., operatively mounted) tool. These embodiments are designed to prevent the worker from dismounting the tool vertically, and to require that the tool be dismounted by sliding it horizontally out of the tool holder's channel C. The tool holder in these embodiments can be of any design disclosed in the present disclosure, and/or any design disclosed in one or both of U.S. patent application Ser. No. 11/053,134 (entitled "Push Plate Tool Holder for Press Brakes," filed Feb. 8, 2005) and Ser. No. 11/178,977 (entitled "Press Brake Clamp Incorporating Tool-Seating Mechanism," filed Jul. 11, 2005), the entire contents of both of which are herein incorporated by reference.

With continued reference to FIGS. 16 and 17, it can be appreciated that the illustrated tool TL is in its operatively-mounted position on the tool holder TH. Here, the tool holder is part of, and/or is on, the upper beam of a press brake. The engagement portion 580 of the safety key K has a bottom surface 580P that is located directly above, and is spaced apart from, a safety shelf SS of the tool holder. The safety shelf SS here defines an upward facing surface that is spaced apart from a downward facing load-delivery surface LD of the tool holder. One of the confronting walls of the tool holder extends vertically between these two surfaces SS, LD. The illustrated bottom surface 580P and safety shelf SS are both horizontal surfaces, although this is not strictly required. A load-receipt surface LR of the tool is in direct contact with a load-delivery surface LD of the tool holder TH. The safety recess SR in which the safety key's engagement portion is received is open to the tool-mount channel. The tool holder TH in these embodiments preferably includes at least one seating member 80. The seating member is mounted on one CW' of the confronting walls CW, CW' of the tool holder so as to be moveable relative to such wall CW'. As noted above, the tools shown in FIGS. 16 and 17 are both operatively mounted. Thus, at least part of the seating member 80 is located in the tool holder's channel C. Further, each illustrated seating member 80 has a contact surface 80T', 80PS that is in direct contact with (e.g., a desired surface on the tang of) the tool. In the present embodiments, the tool holder and tool preferably are configured such that the mounted tool is prevented from being removed vertically from the tool-mount channel by pulling the tool in the pressing direction PD and/or by attempting to tilt the tool relative to the tool holder. For example, in the exemplary embodiments of FIGS. 16 and 17, the tool is so prevented even if the tool holder is adjusted so as to place the tool in a loosely-mounted state, which is defined by a configuration wherein clamping elements 70, 80 of the tool holder are released but an engagement of the tool's safety key and the tool holder's safety shelf retains the tool in the tool-mount channel. In the exemplary embodiments of FIGS. 16 and 17, the bottom surface 580P of the safety key's engagement portion 580 and the tool holder's safety shelf SS are configured such that moving them forcefully into engagement with one another (e.g., by loosening the clamping elements 70, 80 of the tool holder and pulling the tool vertically downward) does not result in a camming action that retracts the safety key. Rather, the safety key is maintained in its extended position, thereby preventing the tool from being moved vertically downward out of the channel C. In FIGS. 16 and 17, the bottom surface 580P of the illustrated safety key K is a downward-facing surface that is at least generally horizontal, and the illustrated safety shelf SS is an upward-facing surface that is at least generally horizontal. It will be appreciated, however, that many different configurations can be used in the present embodiments to prevent the undesired safety-key-retracting camming action.

While preferred embodiments of the present invention have been described, it is to be understood that numerous changes, adaptations, and modifications can be made to the preferred embodiments without departing from the spirit of the invention and the scope of the claims. Thus, the invention has been described in connection with specific embodiments for purposes of illustration. The scope of the invention is described in the claims, which are set forth below.

What is claimed is:

1. A tool holder for a press brake having a pressing axis, the tool holder comprising:

a) a tool-mount channel configured for receiving a tang of the tool, the tool-mount channel being bounded by two confronting walls of the tool holder;

b) a seating member mounted on the tool holder so as to be moveable between an open position and a closed position, wherein a leading end region of the seating member extends into the tool-mount channel when the seating member is in its closed position, said leading end region of the seating member having at least one contact surface to bear forcibly against a desired surface on the tang of the tool so as to deliver to the tool a force having a seating component that is at least generally parallel to the pressing axis;

c) a driver adapted for selective operation by actuating the driver at a desired time, in response to which the seating member moves to its open position, wherein such movement involves at least part of the seating member moving away from the tool-mount channel; and d) a push plate operably coupled to the driver, the push plate being mounted on the tool holder so as to be movable between first and second configurations.

2. The tool holder of claim 1 wherein the driver is a hydraulic driver adapted for being actuated by delivering hydraulic fluid to the driver, in response to which the seating member moves to its open position, such movement involving at least part of the seating member moving away from the tool-mount channel.

3. The tool holder of claim 2 wherein a single block of the tool holder defines at least part of each of said two confronting walls bounding the tool-mount channel, said block housing an internal hydraulic chamber that is part of said hydraulic driver.

4. The tool holder of claim 1 wherein the push plate moves to its second configuration in response to said actuating the driver, the push plate being under a constant force that biases the push plate toward its first configuration.

5. The tool holder of claim 4 wherein the constant force biasing the push plate toward its first configuration is generated by at least one spring member mounted between the push plate and a wall of the tool holder, wherein the push plate is mounted pivotally on the tool holder and has a pivot point, and wherein said spring member is located vertically further from the tool-mount channel than is the pivot point of the push plate.

6. The tool holder of claim 1 wherein the seating member has a trailing end region that is located a distance from the tool-mount channel whether the seating member is in its open or closed position, and wherein the seating member is adapted to move toward its closed position in response to the push plate bearing against a surface on the trailing end region of the seating member.

7. The tool holder of claim 6 wherein the push plate is mounted on the tool holder so as to be moveable from its first configuration to its second configuration by a bending of the push plate.

8. A tool holder for a press brake having a pressing axis, the tool holder comprising:

a) a tool-mount channel configured for receiving a tang of the tool, the tool-mount channel being bounded by two confronting walls of the tool holder;

b) a seating member mounted on a stationary portion of the tool holder so as to be moveable between an open position and a closed position, wherein a leading end region of the seating member extends into the tool-mount channel when the seating member is in its closed position, said leading end region of the seating member having at least one contact surface to bear forcibly against a desired surface on the tang of the tool so as to deliver to the tool a force having a seating component that is at least generally parallel to the pressing axis, wherein the seating member comprises a rigid body mounted slidably in a bore extending through said stationary portion of the tool holder, said stationary portion of the tool holder being defined by a single block that also defines at least part of each of said two confronting walls;

c) a driver adapted for selective operation by actuating the driver at a desired time, in response to which the seating member moves to its open position, wherein such movement involves at least part of the seating member moving away from the tool-mount channel; and d) a push plate operably coupled to the driver, the push plate being mounted on the tool holder so as to be movable between first and second configurations.

9. The tool holder of claim 8 wherein the bore has a first outlet that opens through a desired one of said confronting walls of the tool holder, wherein the leading end region of the seating member projects from said first outlet when the seating member is in its closed position, wherein the bore has a second outlet from which a trailing end region of the seating member projects when the seating member is in its closed position, and wherein said second outlet opens through a wall that is generally opposed to said desired one of said confronting walls.

10. The tool holder of claim 8 wherein the push plate moves to its second configuration in response to said actuating the driver, the push plate being under a constant force that biases the push plate toward its first configuration.

11. The tool holder of claim 8 wherein the push plate moves to its second configuration in response to said actuating the driver, and wherein the seating member is mechanically linked to the push plate such that the seating member is forced by the push plate to move to its open position when the push plate moves to its second configuration.

12. The tool holder of claim 8 wherein said rigid body comprises a pin-like member that moves axially away from the tool-mount channel in response to said actuating the driver.

13. The tool holder of claim 1 wherein the push plate moves to its second configuration in response to said actuating the driver, and wherein the seating member is mechanically linked to the push plate such that the seating member is forced by the push plate to move to its open position when the push plate moves to its second configuration.

14. The tool holder of claim 13 wherein the seating member is mechanically linked to the push plate by virtue of an articulating joint between the push plate and the seating member.

15. The tool holder of claim 14 wherein the articulating joint facilitates simultaneous linear movement of the seating member and pivotal movement of the push plate.

16. The tool holder of claim 13 wherein the seating member is mechanically linked to the push plate by virtue of a male structure of the push plate being received in a female structure of the seating member.

17. The tool holder of claim 16 wherein the female structure of the seating member is a groove defined by the seating member, the male structure of the push plate being received in said groove.

18. The tool holder of claim 17 wherein the seating member is a pin-like member having a rib that bounds at least part of said groove.

19. A tool holder for a press brake having a pressing axis, the tool holder comprising:

a) a tool-mount channel configured for receiving a tang of the tool, the tool-mount channel being bounded by two confronting walls of the tool holder;

b) a pivotable push plate mounted on the tool holder so as to be moveable pivotally between a first configuration and a second configuration, the thus mounted push plate having a pivot point at a desired location;

c) a seating member mounted on a stationary portion of the tool holder so as to be moveable between an open position and a closed position, wherein a leading end region of the seating member extends into the tool-mount channel when the seating member is in its closed position, said leading end region of the seating member having at least one contact surface to bear forcibly against a desired surface on the tang of the tool so as to deliver to the tool a force having a seating component that is at least generally parallel to the pressing axis, wherein the seating member is operably coupled with the pivotable push plate such that the seating member moves to its closed position in response to the push plate pivoting to its first configuration.

20. A tool holder for a press brake, the tool holder comprising:

a) a tool-mount channel configured for receiving a tang of the tool, the tool-mount channel being bounded by two confronting walls of the tool holder;

b) a pivotable push plate mounted on the tool holder so as to be moveable pivotally between a first configuration and a second configuration, the thus mounted push plate having a pivot point at a desired location;

c) a seating member mounted on a stationary portion of the tool holder so as to be moveable between an open position and a closed position, wherein a leading end region of the seating member extends into the tool-mount channel when the seating member is in its closed position, said leading end region of the seating member having at least one contact surface that is adapted to bear forcibly against a desired surface on the tang of the tool so as to deliver to the tool a force having a seating component that is at least generally parallel to the pressing axis, wherein the seating member is operably coupled with the pivotable push plate such that the seating member moves to its closed position in response to the push plate pivoting to its first configuration, wherein the seating member is mechanically linked to the push plate by virtue of an articulating joint that facilitates simultaneous linear movement of the seating member and pivotal movement of the push plate.

21. The tool holder of claim 19 comprising a driver adapted for selective operation by actuating the driver at a desired time, the driver being operably coupled to the push plate, wherein the push plate pivots to its second configuration in response to said actuating the driver, the push plate being under a constant force that biases the push plate toward its first configuration, said constant force being generated by at least one spring member mounted between the push plate and a wall of the tool holder, wherein said spring member is located vertically further from the tool-mount channel than is the pivot point of the push plate.

22. The tool holder of claim 19 comprising a hydraulic driver adapted for being actuated by delivering hydraulic fluid to the driver, in response to which the seating member moves to its open position, such movement involving at least part of the seating member moving away from the tool-mount channel.

23. The tool holder of claim 22 wherein a single block defines at least part of each of said two confronting walls, said block housing an internal hydraulic chamber that is part of said hydraulic driver.

24. The tool holder of claim 19 wherein the seating member has a trailing end region that is located a distance from the tool-mount channel whether the seating member is in its open or closed position, and wherein when the push plate pivots to its first configuration the push plate bears against a surface on the trailing end region of the seating member so as to force the seating member to its closed position.

25. The tool holder of claim 19 wherein the seating member comprises a rigid body mounted slidably in a bore extending through said stationary portion of the tool holder, said stationary portion of the tool holder being defined by a single block that also defines at least part of each of said two confronting walls.

26. A tool holder for a press brake having a pressing axis, the tool holder comprising:

a) a tool-mount channel configured for receiving a tang of the tool, the tool-mount channel being bounded by two confronting walls of the tool holder, wherein a single block defines at least part of each of said two confronting walls, said block housing an internal hydraulic chamber;

b) a seating member mounted on a stationary portion of the tool holder so as to be moveable between an open position and a closed position, wherein a leading end region of the seating member extends into the tool-mount channel when the seating member is in its closed position, said leading end region of the seating member having at least one contact surface to bear forcibly against a desired surface on the tang of the tool so as to deliver to the tool a force having a seating component that is at least generally parallel to the pressing axis;

c) a hydraulic driver adapted for being operated by delivering hydraulic fluid into said internal hydraulic chamber in response to which the seating member moves relative to said stationary portion of the tool holder; and d) a push plate operably coupled to the hydraulic driver, the push plate being mounted on the tool holder so as to be movable between first and second configurations.

27. The tool holder of claim 26 wherein at least part of the seating member moves away from the tool-mount channel upon said delivering hydraulic fluid into said internal hydraulic chamber.

28. The tool holder of claim 26 wherein an inner surface of said hydraulic chamber is defined by said tool holder block, wherein hydraulic fluid is disposed within said hydraulic chamber, said tool holder block being an integral piece of metal, said hydraulic fluid being in direct contact with said inner surface of said hydraulic chamber, said inner surface being defined by the metal of said block.

29. The tool holder of claim 26 wherein the push plate moves to its second configuration in response to said delivering hydraulic fluid into the internal hydraulic chamber, the seating member being operably coupled to the push plate such that the seating member moves to its open position when the push plate moves to its second configuration, the push plate being under a constant force that biases the push plate toward its first configuration.

30. The tool holder of claim 29 wherein the constant force biasing the push plate toward its first configuration is generated by at least one spring member mounted between the push plate and a wall of the tool holder, wherein the push plate is mounted pivotally on the tool holder and has a pivot point, and wherein said spring member is located vertically further from the tool-mount channel than is the pivot point of the push plate.

31. The tool holder of claim 26 wherein the seating member comprises a rigid body mounted slidably in a bore extending through a stationary portion of the tool holder, said stationary portion of the tool holder being defined by said block, which block defines at least part of each of said two confronting walls and houses said internal hydraulic chamber.

32. The tool holder of claim 31 wherein the bore has a first outlet that opens through a desired one of said confronting walls of the tool holder, wherein the leading end region of the seating member projects from said first outlet when the seating member is in its closed position, wherein the bore has a second outlet from which a trailing end region of the seating member projects when the seating member is in its closed position, and wherein said second outlet opens through a wall that is generally opposed to said desired one of said confronting walls.

33. The tool holder of claim 26 wherein the push plate moves to its second configuration in response to said delivering hydraulic fluid into the internal hydraulic chamber, the seating member being operably coupled to the push plate such that the seating member moves to its open position when the push plate moves to its second configuration, and wherein the push plate is mounted on the tool holder so as to be moveable from its first configuration to its second configuration by a bending of the push plate.

34. A method of operating a tool holder for a press brake having a pressing axis, the tool holder comprising:

a) a tool-mount channel configured for receiving a tang of the tool, the tool-mount channel being bounded by two confronting walls of the tool holder;

b) a seating member mounted on the tool holder so as to be moveable between an open position and a closed position, wherein a leading end region of the seating member extends into the tool-mount channel when the seating member is in its closed position, said leading end region of the seating member having at least one contact surface to bear forcibly against a desired surface on the tang of the tool so as to deliver to the tool a force having a seating component that is at least generally parallel to the pressing axis;

c) a hydraulic driver adapted for selective operation by delivering hydraulic fluid into a hydraulic chamber of the driver in response to which at least part of the seating member moves away from the tool mount channel; and d) a push plate operably coupled to the hydraulic driver, the push plate being mounted on the tool holder so as to be movable between first and second configurations;

wherein the method comprises delivering such hydraulic fluid into the hydraulic chamber at a pressure of at least about 1,000 pounds per square inch.

35. The method of claim 34 wherein a block of the tool holder defines at least part of each of said two confronting walls, said block housing the hydraulic chamber of the driver.

36. The method of claim 35 wherein the seating member comprises a rigid body mounted slidably in a bore extending through said stationary portion of the tool holder, said stationary portion of the tool holder being defined by said block.

37. The method of claim 34 wherein an inner surface of said hydraulic chamber is defined by a block of the tool holder, said block also defining at least part of at least one of said two confronting walls, wherein hydraulic fluid is disposed within said hydraulic chamber, said tool holder block being an integral piece of metal, said hydraulic fluid being in direct contact with said inner surface of said hydraulic chamber, said inner surface being defined by the metal of said block.

38. A tool holder for a press brake having a pressing axis, the tool holder comprising:

a) a tool-mount channel configured for receiving a tang of the tool, the tool-mount channel being bounded by two confronting walls of the tool holder;

b) a push plate mounted on the tool holder so as to be moveable between a first configuration and a second configuration, wherein the push plate when in its first configuration is under a constant force that provides resistance to the push plate being moved out of its first configuration, the push plate being operably coupled to a driver adapted for selective operation by actuating the driver at a desired time so as to move the push plate to its second configuration;

c) a seating member mounted on the tool holder so as to be moveable between an open position and a closed position, wherein a leading end region of the seating member extends into the tool-mount channel when the seating member is in its closed position, said leading end region of the seating member having at least one contact surface to bear forcibly against a desired surface on the tang of the tool so as to deliver to the tool a force having a seating component that is at least generally parallel to the pressing axis, wherein the seating member is operably coupled with the push plate such that when the push plate is in its first configuration the seating member is in its closed position and when the push plate is in its second configuration the seating member is in its open position, wherein the tang of the tool can be moved vertically into and out of the tool-mount channel when the seating member is in its open position.

39. The tool holder of claim 38 wherein the constant force biasing the push plate is a spring-generated force.

40. The tool holder of claim 38 wherein the driver is a hydraulic driver adapted for being actuated by delivering hydraulic fluid to the driver, in response to which the seating member moves to its open position, such movement involving at least part of the seating member moving away from the tool-mount channel.

41. The tool holder of claim 38 wherein the constant force biasing the push plate is generated by at least one spring member mounted between the push plate and a wall of the tool holder, wherein the push plate is mounted pivotally on the tool holder and has a pivot point, and wherein said spring member is located vertically further from the tool-mount channel than is the pivot point of the push plate.

42. The tool holder of claim 38 wherein the seating member comprises a rigid body mounted slidably in a bore extending through a stationary portion of the tool holder, said stationary portion of the tool holder being defined by a single block that also defines at least part of each of said two confronting walls.

43. The tool holder of claim 42 wherein said rigid body comprises a pin-like member that moves axially away from the tool-mount channel in response to said actuating the driver.

44. The tool holder of claim 38 wherein the seating member is mechanically linked to the push plate by virtue of an articulating joint between the push plate and the seating member.

45. The tool holder of claim 44 wherein the articulating joint facilitates simultaneous linear movement of the seating member and pivotal movement of the push plate.

46. A press brake tool holder and a press brake tool, in combination, the tool being operatively mounted on the tool holder, the tool holder having a tool-seating mechanism and being adapted to move the tool in a pressing direction during a pressing operation, the tool comprising:

a) first and second ends, the first end defining a workpiece-deforming surface that is adapted for contacting a workpiece, the second end being defined by a tang, the tang being provided with a resiliently-biased safety key having a retracted position and an extended position, the safety key being in its extended position and being resiliently biased against movement toward its retracted position;

b) a load-receipt surface;

the tool holder comprising:

i) a tool-mount channel in which is received the tool's tang, the tool-mount channel being bounded by two confronting walls of the tool holder, wherein at least one of the confronting walls defines a safety recess that is open to the tool-mount channel, wherein an engagement portion of the tool's safety key is received in the safety recess, the engagement portion of the safety key having a bottom surface that is located directly above a safety shelf of the tool holder, the bottom surface of the safety key's engagement portion being spaced above the tool holder's safety shelf;

ii) a load-delivery surface, the load-delivery surface being in direct contact with the tool's load-receipt surface;

iii) a seating member mounted on, and for movement relative to, one of the two confronting walls of the tool holder, the seating member being at least part of the tool-seating mechanism, wherein at least part of the seating member is located in the tool-mount channel, and wherein the seating member has a contact surface that is in direct contact with a desired surface on the tang of the tool;

wherein the operatively-mounted tool has no externally-accessible actuator operably connected to the safety key to facilitate retracting the safety key from its extended position, wherein the tool holder has no externally-accessible actuator that can be operated to retract the safety key of the operatively-mounted tool, and wherein the tool holder and tool are configured such that the tool is prevented from being removed vertically from the tool-mount channel by pulling the tool in the pressing direction and/or by attempting to tilt the tool relative to the tool holder.

47. The combination of claim 46 wherein the tool is prevented, even if the tool holder is adjusted so as to place the tool in a loosely-mounted state, from being removed vertically from the tool-mount channel by pulling the tool in the pressing direction and/or by attempting to tilt the tool relative to the tool holder, the loosely-mounted state being defined by a configuration wherein clamping elements of the tool holder are released but an engagement of the tool's safety key and the tool holder's safety shelf retains the tool in the tool-mount channel.

48. The combination of claim 46 wherein the contact surface of the seating member is a slanted or curved surface.

49. The combination of claim 46 wherein the contact surface of the seating member is a slanted surface, and said desired surface on the tool's tang is a slanted surface.

50. The combination of claim 46 wherein the contact surface of the seating member is defined by a desired portion of the seating member, said desired portion being received in a recess defined by the tool's tang.

51. The combination of claim 50 wherein said recess is a groove in a side of the tool's tang.

52. The combination of claim 46 wherein the seating mechanism comprises two seating members, said two seating members being in direct contact respectively with two opposite sides of tool's tang.

53. The combination of claim 52 wherein the only direct contact between the seating members and the tool's tang is provided by planar surfaces of the seating members being in direct contact with respective planar surfaces of the tool's tang.

54. The combination of claim 46 wherein the bottom surface of the safety key's engagement portion and the tool holder's safety shelf are configured such that moving them forcefully into engagement with one another does not result in a camming action that retracts the safety key.

55. The combination of claim 46 wherein the bottom surface of the safety key's engagement portion is a downward-facing surface that is at least generally horizontal, and wherein the safety shelf of the tool holder is an upward-facing surface that is at least generally horizontal.

56. A tool holder for a press brake having a pressing axis, the tool holder comprising:

a) a tool-mount channel configured for receiving a tang of the tool;

b) a seating member mounted on the tool holder so as to be moveable between an open position and a closed position, wherein a leading end region of the seating member extends into the tool-mount channel when the seating member is in its closed position, said leading end region of the seating member having at least one contact surface to bear forcibly against a desired surface on the tang of the tool so as to deliver to the tool a force having a seating component that is at least generally parallel to the pressing axis; and c) a driver adapted for selective operation by actuating the driver at a desired time, in response to which the seating member moves to its open position, wherein such movement involves at least part of the seating member moving away from the tool-mount channel, wherein the driver is operably coupled to a push plate, the push plate being mounted on the tool holder so as to be moveable between first and second configurations, wherein the push plate moves to its second configuration in response to said actuating the driver, and wherein the seating member is mechanically linked to the push plate such that the seating member is forced by the push plate to move to its open position when the push plate moves to its second configuration.

57. The tool holder of claim 56 wherein the seating member is configured such that the seating component is directed to move the tool relative to the tool holder until load-bearing surfaces of the tool holder and tool contact one another.

58. The tool holder of claim 56 wherein the seating member is configured such that the seating component is an upward force component.

59. The tool holder of claim 1 wherein the seating member is configured such that the seating component is directed to move the tool relative to the tool holder until load-bearing surfaces of the tool holder and tool contact one another.

60. The tool holder of claim 1 wherein the seating member is configured such that the seating component is an upward force component.

61. The tool holder of claim 1 wherein the tool holder is adapted to move the tool along the pressing axis when the tool is operatively mounted on the tool holder.

62. The tool holder of claim 1 wherein the tool holder is adapted to secure the tool in a stationary position during pressing operations.

* * * * *